US007490931B2

(12) United States Patent
Hasebe et al.

(10) Patent No.: US 7,490,931 B2
(45) Date of Patent: Feb. 17, 2009

(54) IMAGE FORMING APPARATUS HAVING A PLURALITY OF PRINTING HEADS

(75) Inventors: Takashi Hasebe, Sagamiko-machi (JP); Saburo Shimizu, Hachioji (JP); Atsushi Nakajima, Hachioji (JP); Satoshi Masumi, Odawara (JP); Tetsu Sekine, Sagamihara (JP); Shuta Hamada, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 294 days.

(21) Appl. No.: 11/581,541

(22) Filed: Oct. 17, 2006

(65) Prior Publication Data

US 2007/0085890 A1 Apr. 19, 2007

Related U.S. Application Data

(62) Division of application No. 10/795,273, filed on Mar. 9, 2004, now Pat. No. 7,152,970.

(30) Foreign Application Priority Data

Mar. 12, 2003 (JP) ..... 2003-066230
Mar. 19, 2003 (JP) ..... 2003-074901
Mar. 28, 2003 (JP) ..... 2003-090895

(51) Int. Cl.
*B41J 2/01* (2006.01)
*B41J 29/38* (2006.01)
*B41J 29/393* (2006.01)

(52) U.S. Cl. ..... 347/102; 347/14; 347/19

(58) Field of Classification Search ..... 347/102, 347/14, 19, 101, 5, 9; 101/488; 219/216; 399/320; 346/25
See application file for complete search history.

(56) References Cited

U.S. PATENT DOCUMENTS 3,953,709 A * 4/1976 Elter ..... 219/216

(Continued)

FOREIGN PATENT DOCUMENTS

JP 07-224241 8/1995

(Continued)

OTHER PUBLICATIONS

Japanese Office Action mailed Jan. 22, 2008, issued in counterpart Japanese Patent Application No. 2003-066230.

*Primary Examiner*—Stephen D Meier
*Assistant Examiner*—Leonard S Liang
(74) *Attorney, Agent, or Firm*—Finnegan, Henderson, Farabow, Garrett & Dunner, L.L.P.

(57) ABSTRACT

In an image recording apparatus equipped with plural printing heads each for jetting ink drops having a photo-setting property towards a recording medium, a conveyance unit for conveying the recording medium to the printing heads, and each of plural light radiation devices for radiating light to the ink drops landed on the recording medium to harden, is arranged at the downstream side of each of the plural printing heads, one having largest light energy, which is located at the most downstream position among the plural light radiation devices is determined at least to satisfy the light energy necessary for hardening of the ink drops jetted by any one of the printing heads positioned upstream thereof, and the light energy becomes smaller gradually for every light radiation device in the order from the light radiation device at the most downstream position to those at more upstream positions.

3 Claims, 14 Drawing Sheets

U.S. PATENT DOCUMENTS

| | | | | |
|---|---|---|---|---|
| 4,355,225 | A * | 10/1982 | Marsh | 219/216 |
| 6,145,979 | A | 11/2000 | Caiger et al. | |
| 6,304,740 | B1 * | 10/2001 | Ciaschi et al. | 399/328 |
| 6,465,799 | B1 * | 10/2002 | Kimble et al. | 250/504 R |
| 6,523,948 | B2 | 2/2003 | Matsumoto et al. | |
| 6,562,413 | B1 | 5/2003 | Morgavi | |
| 6,674,990 | B2 * | 1/2004 | Rohde et al. | 399/336 |
| 6,834,948 | B2 | 12/2004 | Asano et al. | |
| 7,081,638 | B1 * | 7/2006 | Augur | 250/504 R |
| 2003/0035037 | A1 | 2/2003 | Mills et al. | |
| 2003/0184631 | A1 * | 10/2003 | Suzuki et al. | 347/102 |
| 2007/0273739 | A1 * | 11/2007 | Rodin et al. | 347/102 |

FOREIGN PATENT DOCUMENTS

| | | | |
|---|---|---|---|
| JP | 07224241 | A | 8/1995 |
| JP | 2004167917 | A * | 6/2004 |
| JP | 2006035648 | A * | 2/2006 |

* cited by examiner

IMAGE FORMING APPARATUS HAVING A PLURALITY OF PRINTING HEADS

This application is a Divisional of application Ser. No. 10/795,273, filed Mar. 9, 2004 now U.S. Pat. No. 7,152,970, which claims the benefit of priority to Japanese Patent Application No. 2003-066230, filed Mar. 12, 2003; Japanese Patent Application No. 2003-074901, filed Mar. 19, 2003; and Japanese Patent Application No. 2003-090895, filed Mar. 28, 2003, the entire disclosures of which are incorporated herein by reference.

BACKGROUND OF THE INVENTION

This invention relates to an image recording apparatus, and in particular, to an image recording apparatus using photo-setting ink.

In recent years, in comparison with a method requiring plate making, such as a photogravure printing method or a flexographic printing method, an image recording apparatus based on an ink jet printing method has come to be used in a large number of cases for the reason that an image can be recorded simply at a low price.

Further, in a field where an image recording process is applied to a commodity or a package of a commodity by means of an image recording apparatus based on such an ink jet method, a material having no ink absorbing property, such as resin or metal, is used for a commodity or a package of a commodity in many cases. Further, it is known that in an image recording apparatus which uses a material having no ink absorption ability for a recording medium, photo-setting ink is fixed to the recording medium, after being hardened and fixed by the radiation of light, such as ultraviolet rays (for example, the publication of the unexamined patent application 2002-347232).

This image recording apparatus is equipped with a conveyance unit for conveying a recording medium, and over the conveyance path of a recording medium by means of this conveyance unit, a plurality of line type printing heads for jetting photo-setting ink drops are arranged along the conveyance direction. Further, at the downstream side of these printing heads with respect to the conveyance direction, a light radiation device for radiating light to ink drops jetted from the printing heads to harden the ink drops is disposed.

In such an image recording apparatus, it is actualized that, while a recording medium is being conveyed by the conveyance unit, ink drops are being jetted from the printing heads to the recording medium in accordance with specified image information, and after that, by the radiation of light emitted from the light radiation device to the ink drops landed on the recording surface, the ink drops are hardened and fixed on the recording medium.

Further, up to this time, in an image recording apparatus, it has been put into practice that a constant quantity of light is uniformly radiated to the ink drops which have been jetted from the printing heads and landed on a recording medium by the light radiation device to harden the ink drops completely.

However, supposing in the above-mentioned image recording apparatus, the distance to the light radiation device becomes different for each printing head. Owing to this, the time from the landing to the radiation by the light emitted by the light radiation device becomes different for each printing head, which makes the dot diameters after setting have a dispersion. On top of it, there is a possibility that dots of their respective colors after landing are mixed with one another before they reach the light radiation device, which has been the cause of the degradation of color reproducibility.

Further, in recent years, in the same manner as other electronic equipment, it is desired to make the image recording apparatus smaller-sized. However, if the distance between the printing heads and the light radiation device is made smaller, ink mist becomes easy to adhere to the light radiation device. If a large amount of ink mist adheres to the light radiation device, the quantity of light is lowered and becomes incapable of hardening ink drops on a recording medium with certainty. In particular, in the case where a plurality of light radiation devices are provided for the plurality of printing heads respectively, even if one light radiation device is subjected to the lowering of quantity of light, the quantity of light required for the hardening reaction cannot be secured, which becomes the cause of image quality degradation.

SUMMARY OF THE INVENTION

It is the first object of this invention to provide an image recording apparatus to make it possible to suppress the dispersion of dot diameters and the color mixing of ink drops of different colors, to obtain a high-quality image.

It is the second object of this invention to provide stabilized high-quality image recording by the removal of the cause of image quality degradation even if the light radiation device is smudged by the ink mist or the like.

The above-mentioned first object can be accomplished by an image recording apparatus having any one of the following structures (1) to (3).

Structure (1): An image recording apparatus is equipped with a plurality of printing heads each for jetting ink drops having a photo-setting property towards a recording medium, a conveyance unit for conveying said recording medium to make it face each of said printing heads, and a plurality of light radiation devices for radiating light to said ink drops having landed on said recording medium to harden said ink drops, characterized in that said plurality of printing heads are arranged along the conveyance direction of said recording medium which is conveyed by said conveyance unit, each of said plurality of light radiation devices is arranged at the downstream side of each of said plurality of printing heads with respect to said conveyance direction, corresponding to each of the printing heads, the light energy of one of said plural light radiation devices located at the most downstream position is determined at least to satisfy the requirement for the light energy necessary for the hardening of the ink drops jetted by any one of the printing heads positioned upstream of said light radiation device located at the most downstream position, and the relation of the light energy among said plural light radiation devices is determined to be such that the light energy of said light radiation device located at the most downstream position is largest, and the light energy becomes smaller gradually for every light radiation device in the order of the arrangement from said light radiation device located at the most downstream position to those located at more upstream positions.

According to the structure (1), each of the plural light radiation devices is arranged at the downstream side of each of the printing heads with respect to the conveyance direction, corresponding to each of the printing heads. Therefore, it is possible to radiate light to ink drops jetted from their respective printing heads immediately after landing of the ink drops, and the ink drops after landing come to be hardened before ink drops are jetted from the next printing head. Accordingly, it is prevented that ink drops of their respective colors are mixed with one another.

Further, if the interval between the printing head and the light radiation device corresponding to the printing head making a couple is made uniform over all the couples of them, the time from the landing to the radiation by the light emitted from the light radiation devices can be made uniform over all the printing heads, which makes it possible to prevent dot diameters from having a dispersion.

Owing to these, even in a case where line type printing heads are used, it is possible to obtain a high-quality image.

Further, because the light energy of the light radiation device located at the most downstream position is determined to be such one as to satisfy at least the requirement of light energy necessary for the hardening of the ink drops jetted by the printing head adjacent to said light radiation device, it is possible to harden ink drops landed on a recording medium with certainty.

Incidentally, as regards ink drops jetted from the printing heads other than printing head located at the most downstream position among the plural printing heads, light is radiated to them by the plural light radiation devices including at least the light radiation device located at the immediately downstream position of the printing head concerned and the light radiation device located at the most downstream position. For example, in the case of ink drops jetted from the printing head located at the most upstream position, light from all the light radiation devices is radiated to the ink drops, and when the ink drops have passed the most downstream light radiation device, light energy from all the light radiation devices is accumulated. If the quantity of this accumulated light energy is too great, it degrades the ink drops themselves, which makes it difficult to develop the color intended. If the quantity of this accumulated light energy is too great, it accelerates the solidification of the ink drops and produces a wave-shaped deformation (a phenomenon showing a recording medium being tensioned in the direction of solidification of ink drops, which makes it necessary to apply an after-processing to the recording medium (a processing applied to the recording medium by means of a heating-and-pressing roller or a pressing roller), and becomes an obstacle in making the apparatus low-powered and small-sized.

Usually, if ink drops landed on a recording medium are hardened (initial hardening) before ink drops from the next printing head land on the medium to a hardness of such a degree as not to be mixed with the ink drops from the next printing head, it can be prevented that ink drops of different colors are mixed with one another. However, if the light energy of the light radiation devices are made to be equal to the light energy of the light radiation device located at the most downstream position as described before, it makes a radiation of light energy larger than that required for the initial hardening, which is not desirable also from the view point of energy saving. For this reason, as described in the structure (1) of this invention, by the relation of the light energy between the plural light radiation devices being determined to be such that the light energy of the light radiation device located at the most downstream position is largest, and the light energy becomes smaller gradually for every light radiation device in the order of their arrangement from said light radiation device located at the most downstream position to those located at more upstream positions. It becomes possible that, while ink drops are subjected to initial hardening immediately after landing, the ink drops are made to develop the color intended and the consumption of energy is suppressed. Further, because no after-processing for a recording medium is required, it is possible to achieve an improvement in making the image recording apparatus low-powered and small-sized.

In addition, it is necessary to prepare the ink which is jetted from the printing heads other than the most downstream printing head in such a manner as to make initial hardening by the light energy of the light radiation device corresponding to the printing head concerned.

Structure (2): An image recording apparatus is equipped with a plurality of printing heads for jetting ink drops having a photo-setting property towards a recording medium, a conveyance unit for conveying said recording medium to make it face said printing heads, a plurality of light radiation devices for radiating light to said ink drops having landed on said recording medium to harden said ink drops, an operation section capable of inputting a setting value of the light energy of each of said light radiation devices, and a control device for controlling said plural light radiation devices on the basis of the input result from said operation section and also controlling said printing heads and said conveyance unit, characterized in that said plurality of printing heads are arranged along the conveyance direction of said recording medium conveyed by said conveyance unit, each of said plurality of light radiation devices is arranged at the downstream side of each of said plurality of printing heads with respect to said conveyance direction, corresponding to each of the printing heads, and said control device produces a test pattern for a user judging whether or not the light energy of each of said light radiation devices is proper on said recording medium by controlling said light radiation devices, said printing heads, and said conveyance unit.

According to the structure (2), each of the plural light radiation devices is arranged at the downstream side of each of the printing heads with respect to the conveyance direction, corresponding to each of the printing heads. Therefore, it is possible to radiate light to ink drops jetted from their respective printing heads immediately after landing, and the ink drops after landing come to be hardened before ink drops are jetted from the next printing head. Accordingly, it is prevented that ink drops of their respective colors are mixed with one another.

Further, if the interval between the printing head and the light radiation device corresponding to the printing head making a couple is made uniform over all the couples of them, the time from the landing to the radiation by the light emitted from the light radiation device concerned can be made constant for all the printing heads, which makes it possible to prevent dot diameters from having a dispersion.

However, because the inks have different light transmittances with their colors, the light energy required for the hardening of the ink becomes different for each color. For example, for the ease of the assembly and adjustment operation of the apparatus, if the light energy is made uniform over all the light radiation devices in accordance with the ink requiring a largest light energy for hardening, not only it abuses the light energy applied, but also, for example, it accelerates the hardening by the excessive light energy for the inks having a different hardening condition, which causes a wave-shaped deformation phenomenon lowering the flatness of the recording medium, to make a factor to lower the recording quality. On the other hand, if the light energy is made to be uniform over all the light radiation devices in accordance with the ink requiring a smallest light energy for hardening, ink drops become mixed with one another and a low-quality image is recorded. That is, if it is possible to make each of the light radiation devices emit light having a light energy necessary for the hardening of the ink of the color of which the light radiation device concerned is in charge, it is possible to suppress the energy consumption with a high-quality image maintained. For this reason, according to the invention described in the structure (2), because a test pattern for a user judging whether or not the light energy of each of the light radiation devices is proper is produced on a recording medium by the control of the control device, the user can judge the setting value of the light energy which is most suitable to the image recording on the basis of the result of production of the test pattern. Further, if the setting value judged to be optimum by the user is inputted to the operation section, the control device controls the plural light radiation devices on the basis of the input result and records an image. By this, it is possible to obtain a high quality image which is excellent also from the viewpoint of energy saving.

Structure (3): An image recording apparatus is an image recording apparatus of a structure as set forth in the structure (2) characterized in that the aforesaid control device produces the aforesaid test pattern by utilizing at least two sets composed of a set of the aforesaid light radiation device which is an object of the aforesaid adjustment and the printing head corresponding to said light radiation device concerned and a set of the light radiation device adjacent to said light radiation device which is the object of the adjustment and the printing head corresponding to said light radiation device concerned.

According to the structure (3), the test pattern is produced through the utilization of at least two sets composed of a set of the light radiation device which is the object of the adjustment and the printing head corresponding to said light radiation device concerned and a set of the light radiation device adjacent to the light radiation device which is the object of the adjustment and the printing head corresponding to said light radiation device concerned. Therefore, it is actualized that the test pattern is produced at least with two kinds of ink having a high possibility of being mixed together included. Accordingly, the user, making it the ground for judgement the area on a recording medium composed of two kinds of ink having a high possibility of being mixed together, can judge the setting value of the light energy enabling the suppression of the color mixing to the utmost. Especially, by producing a test pattern by means of the above-mentioned two sets of the light radiation device and the printing head, the user can judge the setting value of the light energy easily without being disturbed by other colors.

The above-mentioned second object can be accomplished by any one of the following structures (4) to (6).

Structure (4): An image recording apparatus is equipped with a conveyance unit for conveying a recording medium, a printing head composed of a plurality of unit heads each for jetting photo-setting ink drops toward said recording medium arranged along the direction perpendicular to the conveyance direction of said recording medium, a light radiation device for radiating light from a light source to said ink drops having been jetted from said plurality of unit heads and landed on said recording medium at the downstream side of said printing head with respect to said conveyance direction, a light transmitting protection member capable of replacement disposed at the side of said recording medium with respect to said light radiation device, a light amount measuring sensor for measuring the light amount of said light radiation device, a storage section for storing a target light amount value of said light radiation device, a notification section for notifying a user of the condition of said light radiation device, and a control device for controlling the light amount of said light radiation device and said notification section on the basis of the measured value by said light amount measuring sensor and said target light amount value of said storage section, characterized in that said control device compares said measured value of said light radiation device with said target light amount value before an image recording, if said measured value of said light radiation device is less than said target light amount value, increases the light amount of said light radiation device until it reaches or exceeds said target light amount value, and if said measured value of said light radiation device after the increasing of light amount does not reach said target light amount value, controls said notification section to notify a user of the replacement of said protection member of said light radiation device.

According to the structure (4), because a protection member is provided in the light radiation device in such a manner as to be capable of replacement, the light radiation device itself, that is, the light source and the reflection member can be protected against smudging, and even if the light amount is lowered, it can be recovered by the replacement of the protection member.

Further, the control device compares the measured value of the light radiation device with the target light amount value prior to recording an image, and if the measured value is less than the target light amount value, it increases the light amount of the light radiation device until it reaches or exceeds the target light amount or greater. Therefore, even if the light radiation device is smudged by the adherence of ink mist etc., the light amount necessary for the hardening of ink drops can be secured and an image of a stabilized image quality can be recorded.

Further, if the measured value of the light radiation device does not reach the target light amount value notwithstanding the light amount being increased, the notification section notifies a user of the replacement of the protection member of the light radiation device. Therefore, it never happens for a user to make an error in the replacement time of the protection member, and it is possible to make the replacement with certainty.

Structure (5): An image recording apparatus is an image recording apparatus of a structure as set forth in the structure (4), characterized in that the aforesaid light radiation device is equipped with a slit member having a plurality of slits for transmitting the light from the aforesaid light source onto said recording medium so as to make the transmitted light beams to correspond to the aforesaid plural unit heads respectively and is disposed at the side toward said recording medium with respect to said light source, and a reflection member disposed at the side opposite to said recording medium with respect to said light source for converging the light from said light source onto said plurality of slits, said light source is disposed extending over the whole width of the aforesaid printing head, and the aforesaid protection member is disposed in such a way as to cover said slit member.

According to the structure (5), because the light from the light source is transmitted by the slits onto a recording medium to become light beams correspond to their respective unit heads, even in the case where a plurality of unit heads provided in a printing head are not arranged linearly, if the slits are formed in such a way as to have the distances from their respective unit heads made equal to one another, the time from the landing to the radiation can be made the same for ink drops, from whichever unit heads they may be jetted. Accordingly, the dispersion of dot diameters can be suppressed, and the image quality can be improved.

Further, because the protection member is disposed in such a way as to cover the slit member, it is possible to prevent that ink mist etc. invade from the silts.

Structure (6): An image recording apparatus is an image recording apparatus of a structure as set forth in the structure (4) or (5), characterized in that the aforesaid control device controls the aforesaid notification section to notify a user of the replacement of the aforesaid light source of the aforesaid light radiation device, in the case where the aforesaid measurement value of the aforesaid light radiation device after the aforesaid increasing of the light amount is not increased from said measured value obtained by a measurement done prior to the increasing of the light amount.

According to the structure (6), in the case where the measured value of the light radiation device after the increasing of the light amount is not increased from the measured value obtained by a measurement done prior to the increasing of the light amount, the notification section notifies a user of the replacement of the light source of the light radiation device; therefore, it never occurs for a user to make an error in the replacement timing of the light source and the replacement can be made with certainty.

DETAILED DESCRIPTION OF THE PREFERRED EMBODIMENT

First Embodiment

In the following, the embodiment of this invention will be explained with reference to FIG. 1 to FIG. 3.

Figure 1:
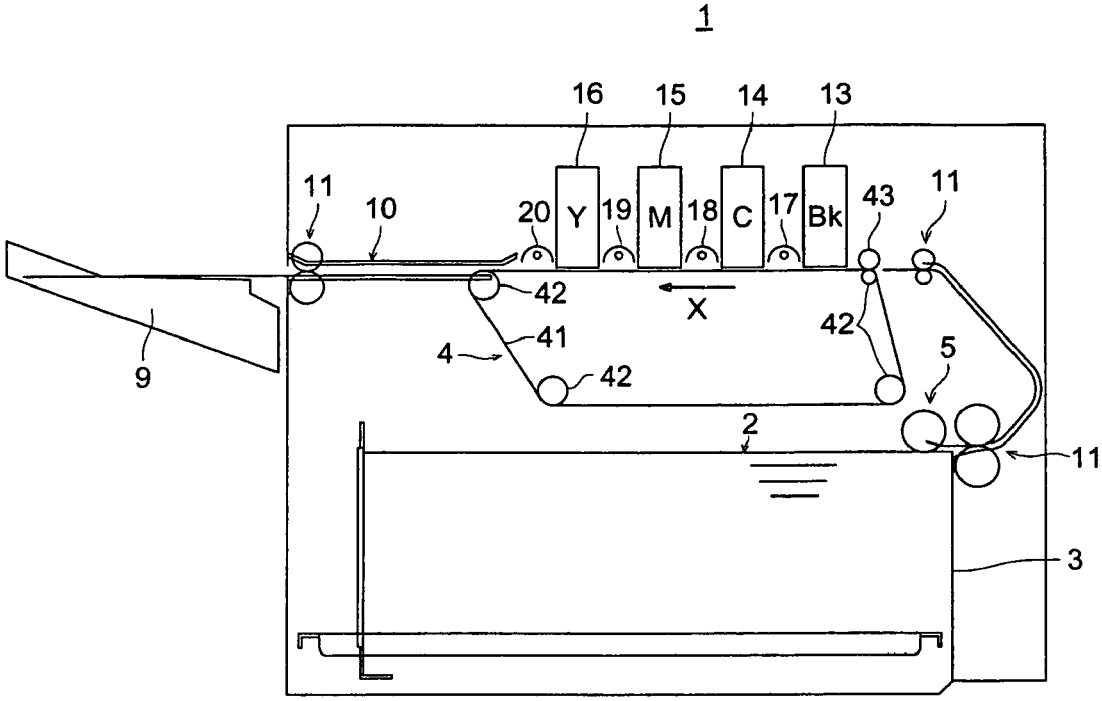
FIG. 1 is an outline drawing representing the outline structure of an image recording apparatus in the first embodiment of this invention.

FIG. 1 shows an image recording apparatus of an example of the embodiment of this invention; in the lower part inside this image recording apparatus 1, there is provided an accommodation tray 3 for accommodating a plurality of stacked recording medium sheets 2. At the upper side of one end portion of this accommodation tray 3, there is provided a takeout device 5 for taking out recording medium sheets 2 on which an image is to be recorded one by one from the accommodation tray 3. In addition, for the recording medium sheet 2, recording medium having a cut-sheet shape made of a material selected from various kinds of paper such as plain paper, recycled paper, and machine-glazed paper, various kinds of fabric, various kinds of non woven fabric, resin, metal, and glass can be employed.

Over the accommodation tray 3, there is provided a conveyance unit 4 for conveying a recording medium sheet 2. In this conveyance unit 4, an endless conveyance belt 41 for conveying a recording medium sheet 2 supported thereon in the horizontal direction is trained about a plurality of tension rollers 42 in a manner capable of revolution. Further, in the conveyance unit 4, there is provided rotatably a pressing roller 43 for pressing the conveyance belt 41 in order to convey a recording medium sheet 2 in a planer manner to a position where the conveyance belt 41 starts contact with a recording medium sheet 2.

At one side of the image recording apparatus 1, there is provided an output tray 9 for receiving ejected recording medium sheets 2 having an image recorded.

Inside the image recording apparatus 1, there is provided a conveyance path 10 for conveying a recording medium sheet 2 supplied from the accommodation tray 3 to the conveyance belt 41, and ejecting it from the conveyance belt 41 to the output tray 9, after the recording sheet 2 has been conveyed along the circumferential surface of the conveyance belt 41. A plurality of pairs of conveyance rollers 11, 11, for conveying a recording medium sheet 2 in the conveyance direction X, are provided at their specified positions in this conveyance path 10.

Further, in the upper neighborhood of the conveyance belt 41, there are provided printing heads 13, 14, 15, and 16 extending over the whole width of the conveyance belt 41 having nozzles (not shown in the drawings) for jetting ink drops of the colors black (Bk), cyan (C), magenta (M), and yellow (Y) to a recording medium sheet 2 arranged along the conveyance direction X in that order of the colors. For these printing heads 13, 14, 15, and 16, line type heads are suitably employed, and they are arranged in a way such that the jetting surface and the circumferential surface of the conveyance belt 41 come to face each other.

Further, in the upper neighborhood of the conveyance belt 41 and at the downstream side of the printing heads of their respective colors 13, 14, 15, and 16 with respect to the conveyance direction X, there are provided light radiation devices 17, 18, 19, and 20 for radiating ink drops jetted from the printing heads 13, 14, 15, and 16 to a recording medium sheet 2 by light of a specified wavelength to harden the surface of the ink drops, corresponding to the printing heads 13, 14, 15, and 16 respectively.

For the light source to be used in the light radiation devices 17, 18, 19, and 20, there is no particular limitation; however, for example, it is desirable to use an LED array having light emitting diodes (LED) emitting ultraviolet rays arranged over the whole width of the conveyance belt 41.

The radiation by the light from these light radiation devices 17, 18, 19, and 20 is designed to be carried out with a quantity of light enough to completely harden the ink drops landed on a recording medium sheet 2 until they pass the most downstream light radiation device 20. Further, it is designed to be carried out with a quantity of light enough to harden the surface of the ink dots (hereinafter referred to as "initial hardening") to a degree such that the ink drops jetted from the printing heads 13, 14, 15, and 16 adjacent to their respective light radiation devices at their upstream side with respect to the conveyance direction X and landed on a recording medium sheet 2 can keep specified dot diameters.

To explain it in detail, as regards the light radiation device 20 disposed at the most downstream position, its light energy is determined to be such that it satisfies at least the requirement to have a value necessary to harden the ink drops jetted from the printing head 16 adjacent to the light radiation device 20.

Now, ink drops which are jetted from the printing head 13, 14, or 15, except for the printing head 16 which is located at the most downstream position among the printing head 13, 14, 15, and 16, and land on a recording medium sheet 2 and are radiated by the light from the plurality of light radiation devices consisting of at least one of the light radiation devices 17, 18, and 19 located at the direct downstream position of the printing heads 13, 14, or 15. For example, in the case of the ink drops jetted from the most upstream printing head 13, they are to be radiated by the light from all the light radiation devices 17, 18, 19, and 20, and when they pass the most downstream light radiation device 20, the light energy from all the light radiation devices 17, 18, 19, and 20 is to be accumulated. If this accumulated light energy quantity is too great, it degrades the ink drops themselves, which makes it difficult to develop the colors intended. If this accumulated energy quantity is too great, solidification of ink drops is accelerated, which produces a wave-shaped deformation of a recording medium sheet 2 (a phenomenon showing a recording medium sheet being tensioned in the solidifying direction of ink), and an after-processing (processing applied to a recording medium by means of a heating-and-pressing roller or a pressing roller) to the recording sheet 2 becomes necessary, which becomes an obstacle in making the apparatus low-powered and small-sized.

Usually, if ink drops landed on a recording medium sheet 2 are hardened before ink drops from the downstream-side printing heads 14, 15, and 16 land on the medium to a hardness of such a degree as not to be mixed with the ink drops from the above-mentioned printing heads, it can be prevented that ink drops of different colors are mixed with one another. However, if the light energy of each of the light radiation devices 17, 18, and 19 is made to be equal to the light energy of the light radiation device 20 located at the most downstream position as described above, it makes a radiation of light energy larger than that required for the initial hardening; this is not desirable also from the view point of energy saving. For this reason, by the relation of the light energy between the light radiation devices 17, 18, 19, and 20 being determined to be such that the light energy of the light radiation device 20 located at the most downstream position is largest, and the light energy becomes smaller gradually for the other light radiation devices in the order of their arrangement from said light radiation device 20 located at the most downstream position to those light radiation devices 19, 18, and 17 located at more upstream positions, in other words, by the relation of the light energy between the light radiation devices 17, 18, 19, and 20 being determined to be such that Light radiation device 20>Light radiation device 19>Light radiation device 18>Light radiation device 17, it becomes possible that, while ink drops are subjected to initial hardening immediately after landing, the ink drops are made to develop the colors intended and the consumption of energy is suppressed. In addition, in the case of light radiation devices capable of varying the light energy value, the setting of the light energy value of the light radiation devices 17, 18, 19, and 20 is carried out by a control to make the light radiation devices satisfy the above-mentioned relation carried out by the control device. On the other hand, in the case of light radiation devices incapable of varying the light energy value, that is, in the case of light radiation devices capable of radiating light of a fixed energy value only, a plurality of light radiation devices of different light energy values are arranged beforehand in such a manner as to satisfy the above-mentioned relation.

Further, because inks have different transmittances for ultraviolet rays due to different pigments included in the inks, the light energy required for hardening each of them is different. On the other hand, because the light radiation devices 17, 18, 19, and 20 are disposed at the direct downstream side of the printing heads 13, 14, 15, and 16 for their respective colors respectively, ink drops jetted at more upstream side have more opportunity for being radiated by the ultraviolet rays, to come to have more light amount radiated. Therefore, it is desirable to arrange the printing heads 13, 14, 15, and 16 which jet ink drops having transmittance for ultraviolet rays becoming smaller in that order from the upstream side with respect to the conveyance direction X, in that the arrangement in this order makes it possible for the light radiation devices 17, 18, 19, and 20 to harden efficiently all the inks with less light amount.

For example, in the case where black (Bk) ink has the lowest transmittance for the ultraviolet rays emitted from the light radiation device 17 and the transmittance becomes higher in the order of inks of cyan (C), magenta (M), and yellow (Y), it is appropriate to arrange the light radiation devices in the order of the printing heads 13, 14, 15, and 16 jetting inks of black (Bk), cyan (C), magenta (M), and yellow (Y) respectively from the upstream side with respect to the conveyance direction X. In addition, because this order of arrangement is determined by the relation between the color materials and their light transmittance, and the above-mentioned order is not always desirable; in order to make the initial hardening certainly, it is necessary to prepare the inks jetted from the printing heads 13, 14, and 15 except for the most downstream printing head 16 so as to be hardened by the light energy from the light radiation devices 17, 18, and 19 corresponding to the printing heads 13, 14, and 15 respectively.

Besides, the inks to be used in this embodiment are inks that are hardened by the radiation of light, in particular, inks of an ultraviolet-setting type that are hardened by the radiation of ultraviolet rays. Inks of an ultraviolet-setting type are generally classified into inks of a radical polymerization type containing a compound capable of radical polymerization as a polymerizable compound and inks of a cation polymerization type containing a compound capable of cation polymerization; both of these two types of ink can be employed for inks to be used in this embodiment, and also it is appropriate to employ an ink of a hybrid type composed of an ink of a radical polymerization type and an ink of a cation polymerization type combined for the ink to be used in this embodiment.

Figure 2:
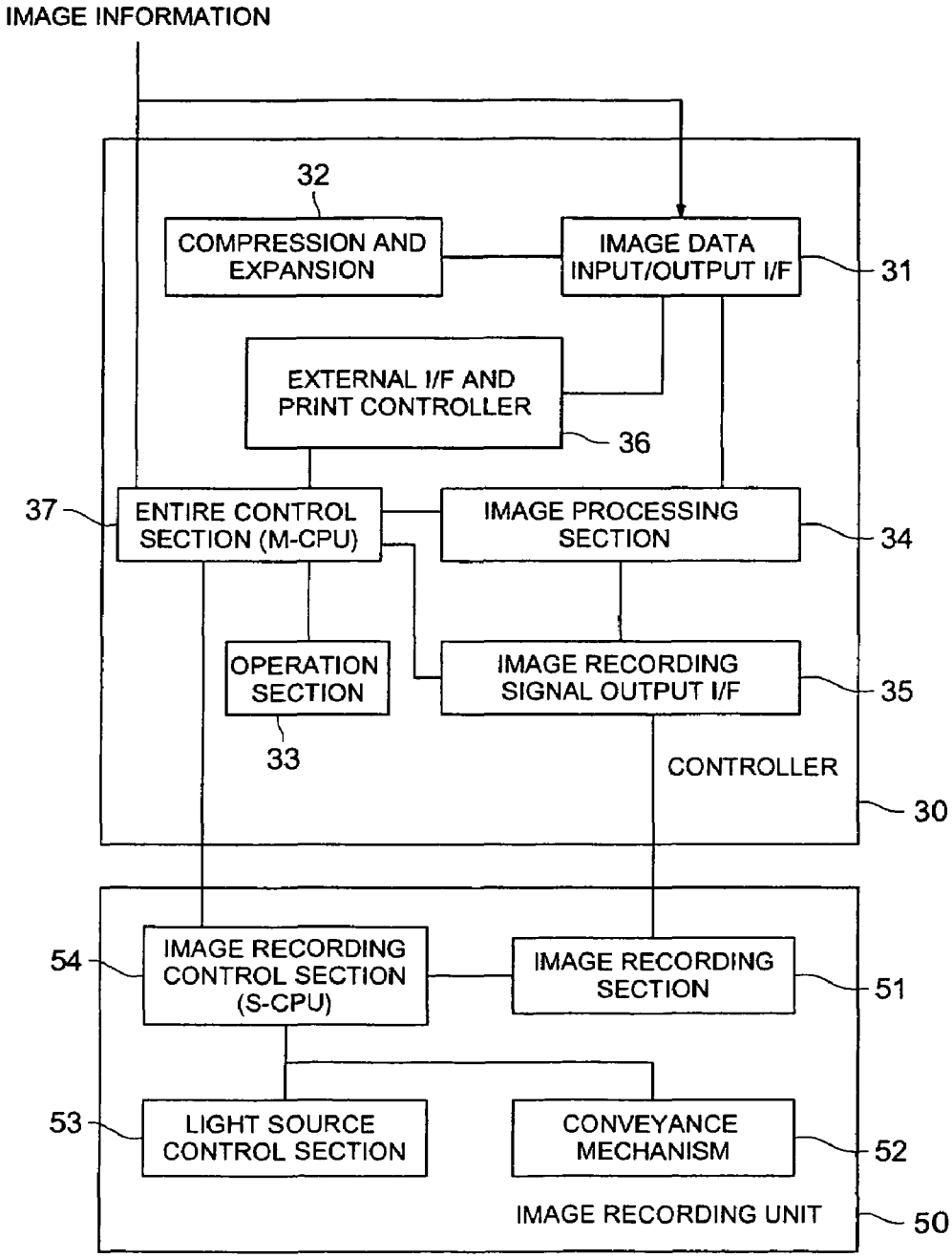
FIG. 2 is a block diagram representing an example of the main control part of the image recording apparatus shown in FIG. 1.

FIG. 2 is a drawing showing a control device for controlling the image recording apparatus 1 in this embodiment of the invention; this control device is composed of, for example, a CPU, a ROM, and a RAM (all are not shown in the drawing), and comprises a controller 30 for developing any one of the processing programs stored in the ROM and practicing this processing program by the CPU.

In the controller 30, there are provided an image data input and output I/F 31 for receiving image information transmitted to the image recording apparatus, and a compression/expansion section 32 for compressing transferred image data by page unit, to store them therein, and further expanding the compressed image data, to store them therein. For the compression/expansion means in this case, JPEG, JPEG2000, JBIG, etc. known to the public can be used. In the controller 30, there are provided an operation section 33 for a user to carry out the inputting of the number of sheets of output, the number of prints, etc. by operation, an image processing section 34 for transforming image data obtained into data adapted to the image output format, and an image recording signal output I/F 35 for outputting the image data transformed in the image processing section 34 to an image recording section 51 of an image recording unit 50. Further, in the controller 30, there is provided an external I/F and print controller 36 for taking in an image obtained by means of an image pickup apparatus such as a digital camera or image data read by another reading apparatus and carrying out image recording based on an instruction from an external apparatus. Further, in the controller 30, there is provided an entire control section (M-CPU) 37 for controlling the operation of the image processing section 34, the image recording signal output I/F 35 and external I/F and print controller 36 in accordance with the operation section 33 and the above-mentioned image information.

In the image recording unit 50, there are provided the image recording section 51 for carrying out image recording in accordance with a signal from the image recording signal output I/F 35, a conveyance mechanism 52 for making the conveyance rollers 11 and the tension rollers 42 operate, a light source control section 53 for controlling the output of the light radiation devices 17, 18, 19, and 20 in accordance with a control signal from the image recording section 51, and an image recording control section (S-CPU) 54 for controlling the operation of the above-mentioned structural constituents.

Figure 3:
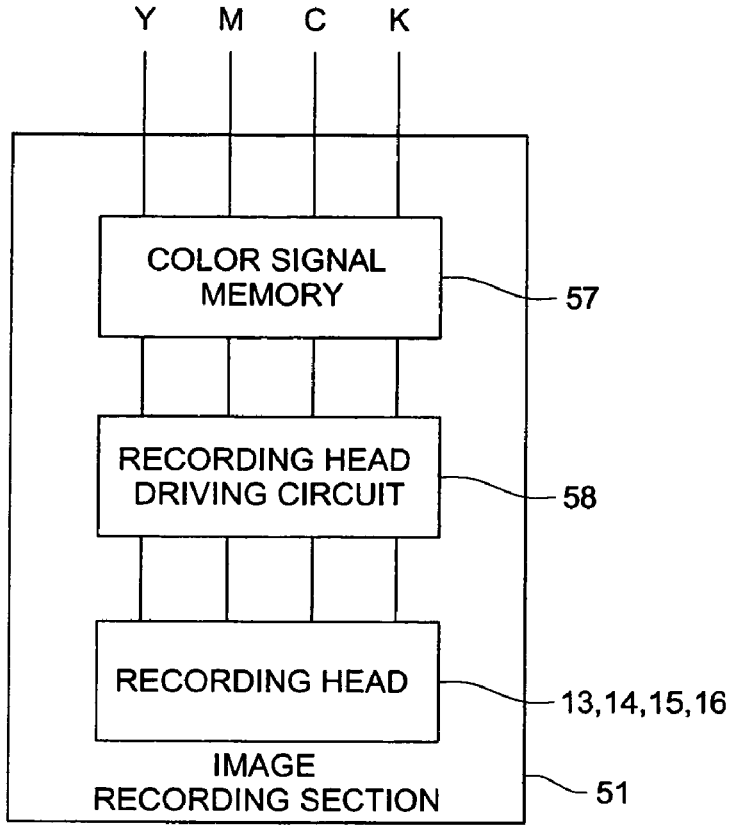
FIG. 3 is a block diagram representing the structure of the image recording section shown in FIG. 2.

FIG. 3 is a block diagram showing the structure of the image recording section 51 in detail. In this image recording section 51, there are provided a color signal storage 57 composed of a plurality of buffer storages provided for each color in order to store color signals transmitted from the image recording signal output I/F 35 and a buffer storage control circuit for controlling the output from the buffer storages, and a printing head driving circuit 58 for controlling the driving of the ink jetting operation of the printing heads 13, 14, 15, and 16 on the basis of color signals outputted in accordance with the control by the above-mentioned buffer storage control circuit.

Next, the operation of the image recording apparatus of this embodiment will be explained.

First, when image information is transmitted to the image recording apparatus 1, as shown in FIG. 2, the transmission of image information is made to the entire control section 37 of the controller 30, and also to the image processing section 34 through the image data input and output I/F 31. Besides, image information is transmitted from an external apparatus or the like to the entire control section 37 also through the external I/F and print controller 36.

The entire control section 37 makes the operation of the structural constituents of the controller 30 start when image information has been transmitted to it. In addition, as regards the timing of this start of the operation, it is not limited to the time of input of image information, but also it is appropriate to start the operation when an operational input by a user is made from the operation section 33 or when an operational input from an external apparatus is made through the external I/F and print controller 36.

In the image processing section 34, image processing is applied to image data so as to make the image information adaptable to the image output format, that is, so as to make image information optimum for an image recording apparatus using photo-setting inks to record an image. The image data composed of color signals that have been subjected to the image processing are transmitted from the image recording signal output I/F 35 to the image recording section 51 of the image recording unit 50.

In addition, also it is possible to transmit image information prior to image processing from the image data input and output I/F 31 to the compression/expansion section 32 to store the information therein. Besides, the compression/expansion section 32 operates not only at the time image data have been transmitted from the image processing section 34 but also at the time an operational input for the start of operation or the like has been made from an external apparatus through the external I/F and print controller 36.

On the other hand, when image information is transmitted to the image recording apparatus 1, the image recording control section 54 of the image recording unit 50 brings the conveyance mechanism 52 and the light source control section 53 into operation on the basis of the color signals stored in the color signal storage 57 of the image recording section 51. Accompanied by this operation, the printing head driving circuit 58 brings the printing heads 13, 14, 15, and 16 into operation. To state it concretely, the conveyance mechanism 52 brings the takeout device 5 into operation, to take out the uppermost recording medium sheet 2 accommodated in the accommodation tray 3, and brings the conveyance rollers 11 into rotational operation to make them convey this recording medium sheet 2 having been taken out.

Further, when the leading edge of the recording medium sheet 2 has reached the conveyance belt 41, the pressing roller 43 presses the leading edge portion of the recording medium sheet 2 to the circumferential surface of the conveyance belt 41 to make it hold the sheet. Because the conveyance belt 41 is made to revolve by the tension rollers 42, the recording medium sheet 2 is conveyed with the revolution. When the recording medium sheet 2 is conveyed to the position of the printing head 13, black ink drops are jetted from the printing head 13, and immediately after that, the black ink drops are radiated by the light from the light radiation device 17, to be subjected to initial hardening. Subsequently, cyan ink drops are jetted from the printing head 14, and the cyan ink drops are subjected to initial hardening by the radiation of light from the light radiation device 18. In the same way, the printing head 15 is brought into operation to jet magenta ink drops onto the recording medium sheet 2, and the ink drops are subjected to initial hardening by the light radiation device 19. After that, the printing head 16 is brought into operation to jet yellow ink drops onto the recording medium sheet 2, and all the ink drops which have been landed on the recording medium sheet 2 are completely hardened by the light radiation device 20.

As explained above, by the initial hardening being carried out after the jetting of ink drops of each color before the jetting of ink drops of the next color, it is possible for ink dots of one color not to be mixed with the neighboring ink dots of another color.

After complete hardening, when the leading edge portion of the recording medium sheet 2 is detached from the circumferential surface of the conveyance belt 41, the recording medium sheet 2 is conveyed by the conveyance rollers 11, to be ejected onto the output tray 9.

As explained up to now, by the image recording apparatus 1 of this embodiment of the invention, because each of the plural light radiation devices 17, 18, 19, and 20 is disposed at the downstream side of each of the printing heads 13, 14, 15, and 16 with respect to the conveyance direction X, it is possible to radiate light to ink drops jetted from their respective printing heads 13, 14, 15, and 16 immediately after the landing, and the ink drops jetted from printing head 13 are hardened before ink drops are jetted from the subsequent printing heads 14, 15, and 16. Accordingly, it is possible to prevent ink dots of different colors from being mixed with one another.

Further, if the interval between any one of the printing heads 13, 14, 15, and 16 and the corresponding one of the light radiation devices 17, 18, 19, and 20 making a couple is made uniform over all the couples, it is possible over all the printing heads 13, 14, 15, and 16 to make it uniform the time interval between the landing to the radiation by the light from the corresponding light radiation devices 17, 18, 19, and 20 respectively, and it is possible to prevent the dot diameters from having a dispersion.

Next, the second embodiment of this invention will be explained. In addition, to the same structural elements as the first embodiment are attached the same signs, and their explanation will be omitted.

Figure 4:
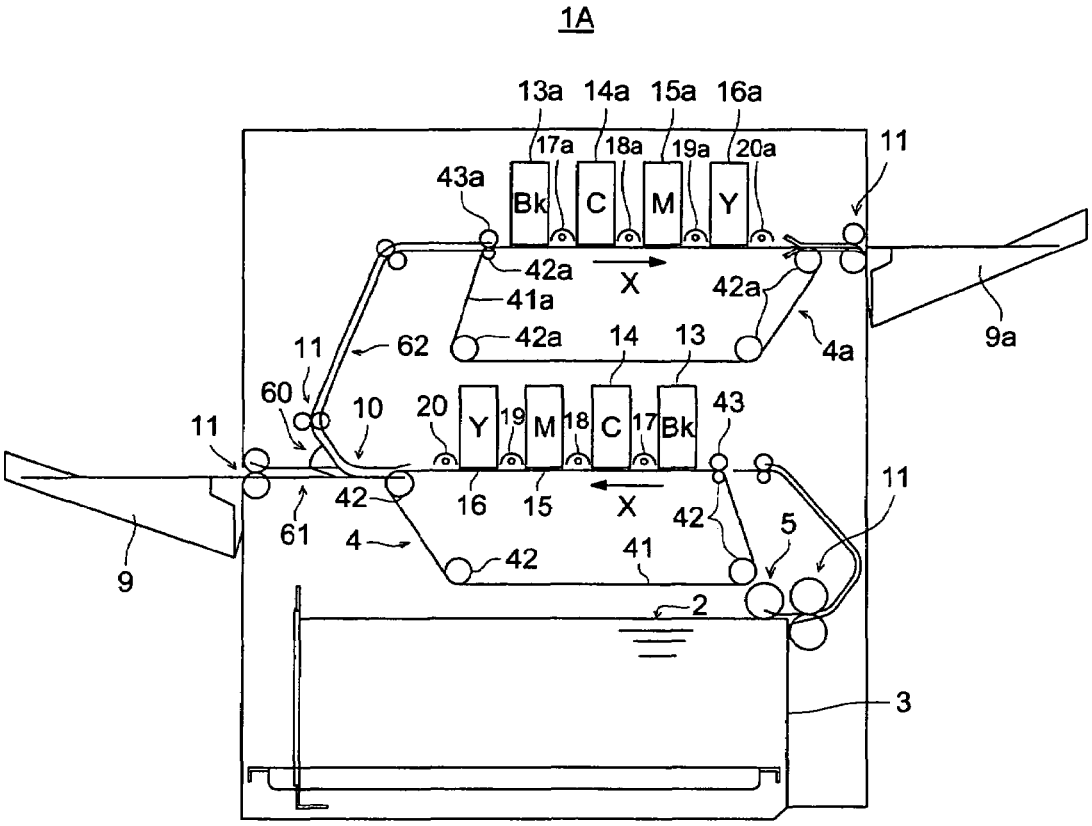
FIG. 4 is an outline drawing representing the outline structure of an image recording apparatus in the second embodiment of this invention.

The image recording apparatus 1 shown as an example in the first embodiment has a structure such that an image is recorded on one side (front surface) of a recording medium, that is, a structure such that only simplex printing is made; however, in this second embodiment, an image recording apparatus 1A capable of recording an image on each of both sides of a recording medium sheet 2 will be explained with reference to FIG. 4 and FIG. 5.

At the downstream side of a conveyance unit 4 of the image recording apparatus 1A, there is disposed a bifurcation section 60 for making a conveyance path 10 for a recording medium sheet 2 bifurcate into two paths. In this bifurcation section 60, there is provided switching mechanism (refer to FIG. 5) for switching the destination of conveyance of a recording medium sheet 2 to a first bifurcation path 61 or a second bifurcation path 62; the destination of conveyance is switched to the first bifurcation path in the case of simplex printing, and to the second bifurcation path 62 in the case of duplex printing.

At the terminal point of the first bifurcation path 61, there is provided an output tray for receiving a recording medium sheet having an image printed on its one side. Further, the second bifurcation path 62 is arranged in such a manner as to bend first upward over the first bifurcation path 61 and next become horizontal, and at its terminal point, there is provided an output tray 9*a* for receiving a recording medium sheet having subjected to duplex printing. In this way, because the second bifurcation path 62 is formed in such a way as to become horizontal after bending, a recording medium sheet 2 proceeding into the second bifurcation path 62 comes to have its rear side made to face upward in its horizontal state after having passed the bend portion.

In the horizontal portion of the second bifurcation path 62, there is provided a conveyance unit 4*a* for conveying a recording medium sheet 2 with its rear side made to face upward. The conveyance belt 41*a* of this conveyance unit 4*a* is made to revolve in the direction reverse to the conveyance belt 41 by a plurality of tension rollers 42*a*.

Further, in the upper neighborhood of the conveyance belt 41*a*, there are provided, extending over the whole width of the conveyance belt 41*a*, printing heads 13*a*, 14*a*, 15*a*, and 16*a* for jetting ink drops of the colors black (Bk), cyan (C), magenta (M), and yellow (Y) to a recording medium sheet 2 arranged along the conveyance direction X in the above-mentioned order of colors.

Further, in the upper neighborhood of the conveyance belt 41*a* and at the downstream side of each of the printing heads of their respective colors 13*a*, 14*a*, 15*a*, and 16*a* with respect to the conveyance direction X, there is arranged each of light radiation devices 17*a*, 18*a*, 19*a*, and 20*a*, corresponding to each of the printing heads 13*a*, 14*a*, 15*a*, and 16*a* respectively.

Figure 5:
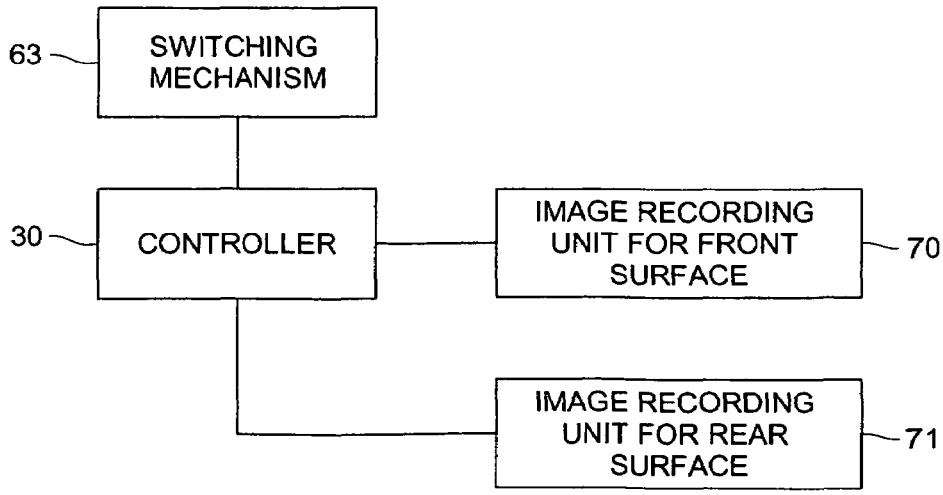
FIG. 5 is a block diagram representing the main control part of the image recording apparatus shown in FIG. 4.

Further, as shown in FIG. 5, to the controller 30, a front side image recording unit 70 for operating the printing heads 13, 14, 15, and 16, the light radiation devices 17, 18, 19, and 20, the conveyance unit 4, etc. in accordance with image data inputted from the controller 30, a rear side image recording unit 71 for operating the printing heads 13*a*, 14*a*, 15*a*, and 16*a*, the light radiation devices 17*a*, 18*a*, 19*a*, and 20*a*, the conveyance unit 4*a*, etc., and a switching mechanism are electrically connected. Besides, the front side image recording unit 70 and the rear side image recording unit 71 has a structure substantially the same as the image recording unit 50 explained in the first embodiment.

Further, the controller 30 is designed to have a function to output image data to the front side image recording unit in the case of simplex printing, and to divide image data into front side image data and rear side image data, to output the front side image data and the rear side image data to the front side recording unit 70 and the rear side recording unit 71 respectively.

Next, the operation of the image recording apparatus of this embodiment will be explained; however, because the operation is the same as that of the image recording apparatus 1 in the first embodiment in an image recording for the front side only, the operation in the case where an image is recorded on each of both sides will be explained.

First, when image information is transmitted to the image recording apparatus 1A, a takeout device 5 of the conveyance mechanism 52 is brought into operation by the controller 30, to take out the uppermost recording medium sheet accommodated in an accommodation tray 3, and the conveyance rollers 11 are brought into rotational operation to convey this recording medium sheet 2 taken out. Further, the controller 30, having recognized that the image recording to be carried out from now on is duplex printing, switches the switching mechanism 63 to make the destination of conveyance the first bifurcation path 61.

Further, when the leading edge of the recording medium sheet 2 reaches the conveyance belt 41, the recording medium sheet 2 is pressed by the pressing roller 43 to be conveyed with the revolution of the conveyance belt 41. When the recording medium sheet 2 is fed to the position of the printing head 13, black ink drops are jetted from the printing head 13, and immediately after that, the ink drops are radiated by the light from the light radiation device 17 to be subjected to initial hardening. Subsequently, cyan ink drops are jetted from the printing head 14, and the cyan ink drops are subjected to initial hardening by the radiation of light from the light radiation device 18. In the same way, the printing head 15 is brought into operation to jet magenta ink drops onto the recording medium sheet 2, and the ink drops are subjected to initial hardening by the light radiation device 19. After that, the printing head 16 is brought into operation to jet yellow ink drops onto the recording medium sheet 2, and all the ink drops which have been landed on the recording medium sheet 2 are completely hardened by the light radiation device 20.

After that, when the leading edge of the recording medium sheet 2 is conveyed to the bifurcation section 60, the recording medium sheet 2 is guided to the second bifurcation path 62 by the switching mechanism 63, to be conveyed therein. When the leading edge of the recording medium sheet 2 having its rear side made to face upward reaches the conveyance belt 41*a*, the recording sheet 2 is pressed by the pressing roller 43*a*, to be conveyed with the revolution of the conveyance belt 41*a*. When the recording medium sheet 2 is fed to the position of the printing head 13*a*, black ink drops are jetted from the printing head 13*a*, and immediately after that, the black ink drops are radiated by the light from the light radiation device 17*a* to be subjected to initial hardening. Subsequently, cyan ink drops are jetted from the printing head 14*a*, and the cyan ink drops are subjected to initial hardening by the radiation of light from the light radiation device 18*a*. In the same way, the printing head 15*a* is brought into operation to jet magenta ink drops onto the recording medium sheet 2, and the ink drops are subjected to initial hardening by the light radiation device 19*a*. After that, the printing head 16*a* is brought into operation to jet yellow ink drops onto the recording medium sheet 2, and all the ink drops which have been landed on the recording medium sheet 2 are completely hardened by the light radiation device 20*a*.

After complete hardening, when the leading edge of the recording medium sheet 2 is detached from the circumferential surface of the conveyance belt 41*a*, the recording medium sheet 2 is conveyed by the conveyance rollers 11 to be ejected onto an output tray 9*a*.

As explained up to now, by this image recording apparatus 1A of the second embodiment, even in the case where an image is recorded on each of both sides of an image recording medium sheet 2, it is possible to radiate light to ink drops jetted from their respective printing heads 13, 14, 15, 16, 13*a*, 14*a*, 15*a*, and 16*a* immediately after the landing, and the ink drops after landing is to be hardened before ink drops are jetted from the subsequent printing heads. Accordingly, it is possible to prevent that ink dots of different colors are mixed with one another, and a high-quality image can be obtained.

In addition, it is a matter of course that this invention is not limited to the above-mentioned embodiment, but it can be suitably altered.

According to the structure (1), it is possible to radiate light to the ink drops jetted from the respective printing heads immediately after landing, and the ink drops after landing come to be hardened before ink drops are jetted from the next printing head. Accordingly, it is prevented that ink drops of their respective colors are mixed with one another.

Further, if the interval between the printing head and the light radiation device corresponding to the printing head making a couple is made uniform over all the couples of them, the time from the landing to the radiation by the light emitted from the light radiation device concerned can be made uniform for all the printing heads, which makes it possible for the dot diameters to have a dispersion.

Owing to these, even in a case where line type printing heads are used, it is possible to obtain a high-quality image.

Further, by the relation of the light energy between the plural light radiation devices being determined to be such that the light energy of the light radiation device located at the most downstream position is largest, and the light energy becomes smaller gradually for the light radiation devices in the order of their arrangement from said light radiation device located at the most downstream position to those located at more upstream positions, it becomes possible that, while ink drops are subjected to initial hardening immediately after landing, the ink drops are made to develop the color intended and the consumption of energy is suppressed.

In the following, another embodiment of this invention will be explained with reference to FIG. 6 to FIG. 9.

Figure 6:
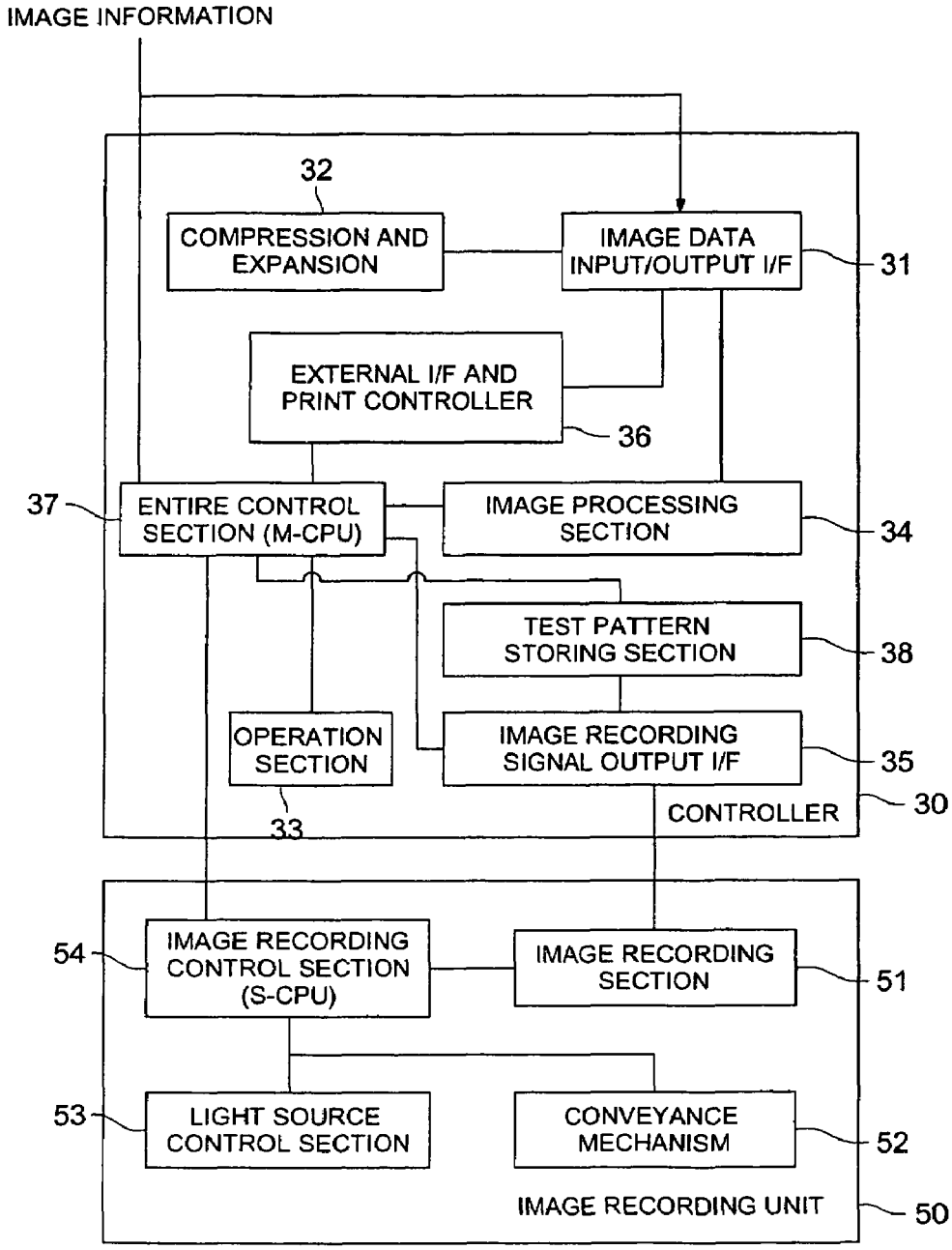
FIG. 6 is a block diagram representing another example of the main control part of the image recording apparatus shown in FIG. 1.

FIG. 6 is a drawing showing a control device for controlling an image recording apparatus 1 in this embodiment of the invention; this control device is composed of, for example, a CPU, a ROM, and a RAM (all are not shown in the drawing), and comprises a controller 30 for developing any one of the processing programs stored in the ROM and practicing this processing program by the CPU.

In the controller 30, there are provided an image data input and output I/F 31 for receiving image information transmitted to the image recording apparatus, and a compression/expansion section 32 for compressing transferred image data by page unit to store them therein, and further expanding the compressed image data to store them therein. For the compression/expansion means in this case, JPEG, JPEG2000, JBIG, etc. known to the public can be used.

Further, in the controller 30, there is provided an operation section 33 for inputting various kinds of instruction. To the operation section 33, designations such as the setting value of the light energy of light radiation devices 17, 18, 19, and 20, the kind of image formation, the number of sheets to be outputted, the number of copies, etc. are inputted. It is actualized that the light energy range between the upper limit and the lower limit to be able to be radiated by the light radiation devices 17, 18, 19, and 20 is divided into several classes, and when the setting value of the light energy of the light radiation devices 17, 18, 19, and 20 is inputted, the value of any one of the classes (level) can be inputted. In addition, as regards another way, it is appropriate to input a concrete light energy value directly.

Further, as regards the kinds of image formation, there are a normal image formation in which an image is formed on the basis of image information, and a test pattern formation in which a test pattern to become the basis of adjustment of the light radiation devices 17, 18, 19, and 20 is produced.

Figure 7:
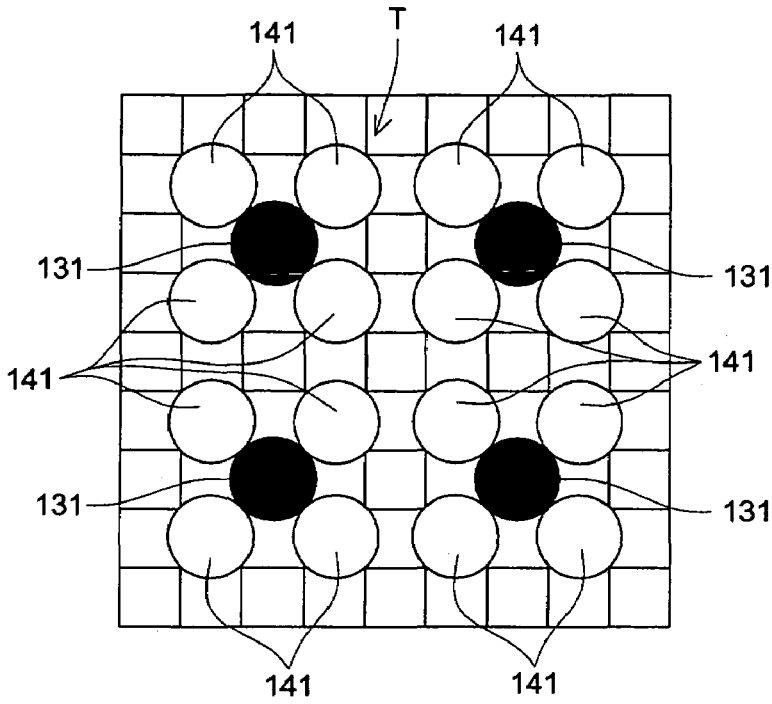
FIG. 7 is an enlargement drawing of a test pattern produced by the image recording apparatus shown in FIG. 1.
Figure 8:
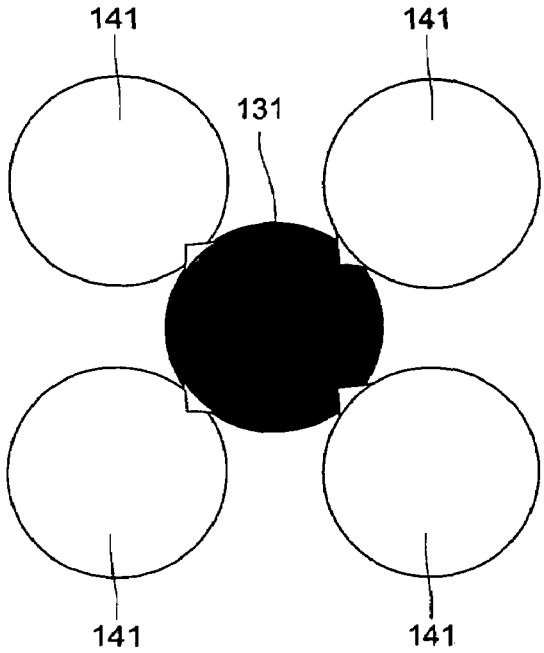
FIG. 8 is an enlargement drawing representing the test pattern shown in FIG. 7 in a deformed state.

In the following, the test pattern will be explained with reference to FIG. 7 and FIG. 8. FIG. 7 and FIG. 8 each are an enlargement drawing of a test pattern T.

The test pattern T denotes an image for an operator judging whether or not the light energy of the light radiation devices 17, 18, 19, and 20 is proper, and is produced by two of printing heads 13, 14, 15, and 16 located at the directly downstream position and upstream position of any one of the light radiation devices 17, 18, 19, and 20 to become the object of the adjustment and two of the light radiation devices 17, 18, 19, and 20 corresponding to these two of the printing heads 13, 14, 15, and 16. For example, in the case where the light radiation device 17 located at the most upstream position is subjected to the adjustment, its test pattern T is produced by the utilization of the two sets, that is, a set of the light radiation device 17 to be subjected to the adjustment and the printing head 13 corresponding to the light radiation device 17, and another set of the light radiation device 18 adjacent to the light radiation device 17 at its downstream side and the printing head 14 corresponding to the light radiation device 18. The test pattern T is produced by ink drops jetted from the printing heads 13 and 14. As shown in FIG. 7, if ink dots 141 produced by the downstream-side printing head 14 are at least in contact with ink dots 131 produced by the upstream-side printing head 13, it is easy to judge whether or not ink dots of different colors are mixed with one another after the formation of the test pattern, and if they overlap one another, it becomes easier to judge. To state it concretely, as shown in FIG. 7, in the case where the ink dots 131 and 141 keep circle-shaped and no color mixing is observed, the light energy of the light radiation device 17 that is the object of the adjustment can be judged to be proper. On the other hand, as shown in FIG. 8, if ink dots of one color invade into the area of ink dots of another color from the contact areas of ink dots 131 and ink dots 141, and color mixing is to be observed, the light energy of the light radiation device 17, the object of the adjustment, can be judged to be improper.

Further, as shown in the controller 30, there are provided an image processing section 34 for transforming data obtained so as to make them adaptable to the image output format, a test pattern storing section 38 for storing image data of a test pattern (test pattern image data), and an image recording signal output I/F 35 for outputting image data transformed in the image processing section 34 and test pattern image data stored in the test pattern storing section 38 to an image recording section 51 of an image recording unit 50.

In the test pattern storing section 38, in order to produce a plurality of test patterns of their respective light radiation devices 17, 18, 19, and 20, a plurality of sets of test pattern image data composed of color signals of pertinent component colors corresponding to the test patterns respectively. To explain it concretely, for example, in the case of the test pattern of the light radiation device 17, its test pattern image data are composed of a magenta color signal and a cyan color signal. Further, in the case of the light radiation device 18, its test pattern image data are composed of a cyan color signal and a magenta color signal, and in the case of the light radiation device 19, its test pattern image data are composed of a magenta color signal and a yellow color signal. Besides, in the case of the light radiation device 20 located at the most downstream position, the light energy is determined beforehand to have a value satisfying at least the requirement of light energy necessary for the hardening of ink drops jetted from the printing head 16 adjacent to the light radiation device 20; therefore, it is unnecessary to adjust the light energy of this light radiation device 20. For this reason, in this embodiment, no test pattern is prepared for the light radiation device 20, but of course it may be appropriate to prepare a test pattern of the light radiation device 20 to adjust the light energy of the light radiation device 20.

Further, in the controller 30, there is provided an external I/F and print controller 36 for taking in image data obtained through an image pick up work by means of a digital camera or the like and image data read by another reading apparatus and carrying out an image recording process based on an instruction from an external apparatus. Further, in the controller 30, there is provided an entire control section (M-CPU) 37 for controlling the operation of the image processing section 34, the image recording signal output I/F 35, and the external I/F and print controller 36 in accordance with the operation section 33 and the above-mentioned image data.

In the image recording unit 50, there are provided the image recording section 51 for carrying out an image recording process in accordance with a signal from the image recording signal output I/F 35, a conveyance mechanism 52 for making conveyance rollers 11 and tension rollers 42 operate, a light source control section 53 for controlling the output of the light radiation devices 17, 18, 19, and 20, and an image recording control section (S-CPU) 54 for controlling the operation of the above-mentioned structural constituents.

As regards the light source control section 53, if the light source of the light radiation devices 17, 18, 19, and 20 are such that its output value is varied with the variation of the electric current as LED's for example, by controlling the electric current, it controls the output of the light radiation devices 17, 18, 19, and 20; however, if the light source is such that its output value is varied with the variation of the voltage as fluorescent light tube for example, it controls the output of the light radiation devices 17, 18, 19, and 20 by controlling the voltage.

Next, the operation of the image recording apparatus of this embodiment will be explained.

First, the operation at the time of a normal image formation will be explained. When an instruction of a normal image formation is inputted from the operation section 33 and image information is transmitted to the image recording apparatus 1, as shown in FIG. 6, the transmission of image information is made to the entire control section 37 of the controller 30, and also to the image processing section 34 through the image data input and output I/F 31. In addition, image information is transmitted to the entire control section 37 also from an external apparatus through the external I/F and print controller 36.

The entire control section 37 makes various components of the controller 30 start their operation. In addition, as regards the timing of this start of the operation, it is not limited to the time image information is inputted, but the operations may be started when an operational input by a user from the operation section 33 or an operational input from an external apparatus through the external I/F and print controller 36 is made.

In the image processing section 34, image processing is applied to image data so as to make the image information adaptable to the image output format, that is, so as to make image information optimum for an image recording apparatus using photo-setting inks to record an image. The image data composed of color signals that have been subjected to the image processing are transmitted from the image recording signal output I/F 35 to the image recording section 51 of the image recording unit 50.

In addition, also it is possible to transmit image information prior to image processing from the image data input and output I/F 31 to the compression/expansion section 32 to store the information therein. Besides, the compression/expansion section 32 operates not only at the time image data have been transmitted from the image processing section 34 but also at the time an operational input for the start of operation or the like has been made from an external apparatus through the external I/F and print controller 36.

On the other hand, when image information is transmitted to the image recording apparatus 1, the image recording control section 54 of the image recording unit 50 brings the conveyance mechanism 52 and the light source control section 53 into operation on the basis of the color signals stored in the color signal storage 57 of the image recording section 51. Accompanied by this operation, a printing head driving circuit 58 brings the printing heads 13, 14, 15, and 16 into operation. To state it concretely, the conveyance mechanism 52 brings the takeout device 5 into operation, to take out the uppermost recording medium sheet 2 accommodated in the accommodation tray 3, and brings the conveyance rollers 11 into rotational operation to make them convey this recording medium sheet 2 taken out.

Further, when the leading edge of the recording medium sheet 2 has reached the conveyance belt 41, the pressing roller 43 presses the leading edge portion of the recording medium sheet 2 to the circumferential surface of the conveyance belt 41 to make it hold the sheet. Because the conveyance belt 41 is made to revolve by the tension rollers 42, the recording medium sheet 2 is conveyed with the revolution. When the recording medium sheet 2 is conveyed to the position of the printing head 13, black ink drops are jetted from the printing head 13, and immediately after that, the black ink drops are radiated by the light from the light radiation device 17 to be subjected to initial hardening. Subsequently, cyan ink drops are jetted from the printing head 14, and the cyan ink drops are subjected to initial hardening by the radiation of light from the light radiation device 18. In the same way, the printing head 15 is brought into operation to jet magenta ink drops onto the recording medium sheet 2, and the ink drops are subjected to initial hardening by the light radiation device 19. After that, the printing head 16 is brought into operation to jet yellow ink drops onto the recording medium sheet 2, and all the ink drops which have been landed on the recording medium sheet 2 are completely hardened by the light radiation device 20.

As explained above, by the initial hardening being carried out after the jetting of ink drops of each color before the jetting of ink drops of the next color, it is possible for ink dots of one color not to be mixed with the neighboring ink dots of another color.

After complete hardening, when the leading edge portion of the recording medium sheet 2 is detached from the circumferential surface of the conveyance belt 41, the recording medium sheet 2 is conveyed by the conveyance rollers 11, to be ejected onto the output tray 9.

Next, the operation at the time of producing a test pattern will be explained. To show as an example a case where the light radiation device 17 is adjusted, first, a user inputs an instruction for the production of a test pattern corresponding to the light radiation device to be subjected to the adjustment, from the operation section 33. By this inputting, as shown in FIG. 6, test pattern image data corresponding to the light radiation device to be subjected to the adjustment are transmitted from the test pattern storing section 38 to the entire control section 37 of the controller 30, and the test pattern image data are also transmitted to the image recording section 51 of the image recording unit 50 through the image recording signal output I/F. The entire control section 37 starts the operation of the various components of the controller 30 when test pattern image data have been transmitted to it.

Figure 9:
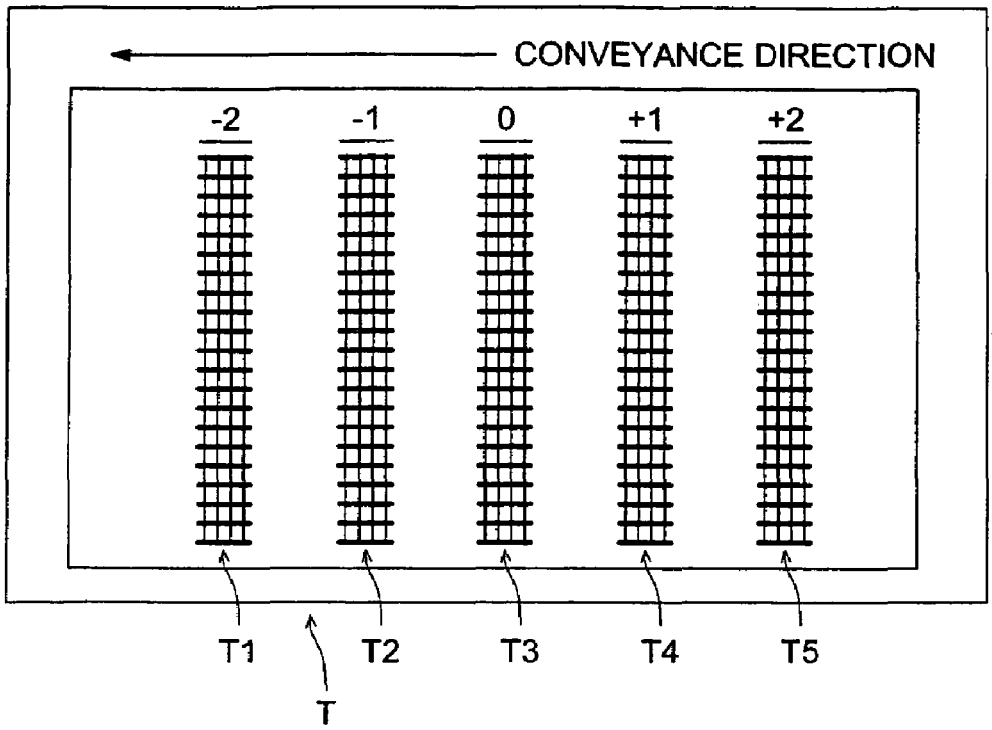
FIG. 9 is an illustration drawing representing the overall view of the arrangement of the plurality of test patterns shown in FIG. 7.

The image recording control section 54 of the image recording unit 50 makes the conveyance mechanism 52 and the light source control section 53 operate on the basis of the color signals stored in the color signal storage 57 of the image recording section 51. Accompanied by this operation, the printing head driving circuit 58 makes the printing head 13 for black ink and the printing head 14 for cyan ink operate. In addition, in this embodiment, in order to make a user easily judge the setting value of the optimum light energy for the image recording, as shown in FIG. 9, a plurality of test patterns with different light energy quantities radiated are produced.

To state it concretely, the conveyance mechanism makes the takeout device 5 operate to take out the uppermost recording medium sheet accommodated in the tray 3, and brings the conveyance rollers 11 into rotational operation, to make them convey the recording medium sheet taken out.

Further, when the leading edge of the recording medium sheet 2 reaches the conveyance belt 41, the pressing roller 43 presses the leading edge portion of the recording medium sheet 2 to the circumferential surface of the conveyance belt 41 to make it hold the sheet. Because the conveyance belt 41 is made to revolve by the tension rollers 42, the recording medium sheet 2 is conveyed with the revolution. When the portion of the recording medium sheet 2 where the first test pattern T1 is to be formed is fed to the position of the printing head 13, black ink drops are jetted from the printing head 13 onto the recording medium sheet 2. Immediately after that, the black ink drops are radiated by the light from the light radiation device 17 to be hardened; at this time, before the light radiation, the light source control section 53 controls the output of the light radiation device 17 to lower the setting value of the light energy of the light radiation device 17 from the setting value at that time to the value lower by two classes. Subsequently, cyan ink drops are jetted from the printing head 14, and the cyan ink drops are hardened by the radiation of light from the light radiation device 18. In addition, it is desirable to stop the light radiation devices 19 and 20 that are not to be involved in the formation of this test pattern T. This is a procedure for judging the color mixing state of neighboring ink dots satisfactorily, and in the case where the judgement is made after the hardening is carried out up to the completion, of course the light radiation devices 19 and 20 may be kept turned on. However, the lighting condition in this case is the device initial condition (standard setting value).

Further, after the first test pattern T1 is produced, when the portion of the recording sheet 2 where the second test pattern T2 is to be formed is conveyed to the position of the printing head 13, black ink drops are jetted from the printing head 13. Immediately after that, the black ink drops are hardened by the radiation of light from the light radiation device 17. The setting value of the light energy of the light radiation device 17 at this time has been raised to a value higher than the setting value at the time the first test pattern T1 was formed by one class. Subsequently, cyan ink drops are jetted from the printing head 14, and the cyan ink drops are hardened by the radiation of light from the light radiation device 18.

Subsequently, in the same way, while the setting value of the light energy of the light radiation device 17 is raised by one class each time, as shown in FIG. 9, when the five test patterns T1, T2, T3, T4, and TS have been formed, with the test pattern T3, which has been formed with the setting value prior to the formation of the test patterns, positioned at the center, the test patterns T1, T2, T4, and T5 which have been formed with the setting value raised by one class for each gradually come to be capable of overall view. The user selects a test pattern of the highest image quality T1, T2, T3, T4, or T5 out of the plural test patterns T1, T2, T3, T4, and T5, and inputs the setting value in the formation of the test pattern of the highest image quality T1, T2, T3, T4, or T5 from the operation section 33. On the basis of this, the control device changes the setting value of the light radiation device 17.

In addition, as regards the other light radiation devices 18, 19, and 20, a plurality of test patterns are formed through the same process, and the user judges an optimum setting value on the basis of them, to input it from the operation section 33.

As explained up to now, by the image recording apparatus 1 of this embodiment, each of a plurality of light radiation devices 17, 18, 19, and 20 is arranged at the downstream side of each of the printing heads 13, 14, 15 and 16 with respect to the conveyance direction X, corresponding to each of the printing heads 13, 14, 15, and 16 respectively; therefore, it is possible to radiate light to ink drops jetted from the printing heads 13, 14, 15, and 16 immediately after landing, and the ink drops after landing is to be hardened before ink drops are jetted from the next printing heads 14, 15, and 16. Accordingly, it is possible to prevent ink drops of different colors from being mixed with one another.

Further, if the interval between any one of the printing heads 13, 14, 15, and 16 and the corresponding one of the light radiation devices 17, 18, 19, and 20 making a couple is made uniform over all the couples of them, it is possible to make the time intervals from the landing to the radiation by the light from the light radiation devices 17, 18, 19, and 20 uniform for all the printing heads 13, 14, 15, and 16, which makes it possible to prevent the dot diameters from having a dispersion.

Further, because the test pattern T for a user judging whether or not the light energy of each of the light radiation devices 17, 18, 19, and 20 is proper is produced on a recording medium sheet 2 by the control of the control device, the user can judge the setting value of the light energy most suitable to the image recording on the basis of the result of production of the test pattern T. Further, if the setting value judged to be optimum by the user is inputted to the operation section 33, the control device controls the plural light radiation devices 17, 18, 19, and 20 on the basis of the input result and records an image. By this, it is possible to obtain a high quality image which is excellent also from the viewpoint of energy saving.

Further, the test pattern is produced through the utilization of two sets composed of a set of the light radiation device 17, 18, 19, or 20 which is the object of the adjustment and the printing head 13, 14, 15, or 16 corresponding to said light radiation device 17, 18, 19, or 20 concerned and a set of the light radiation device 17, 18, 19, or 20 adjacent to the light radiation device 17, 18, 19, or 20 which is the object of the adjustment and the printing head 13, 14, 15, or 16 corresponding to said light radiation device 17, 18, 19, or 20 concerned; therefore, it is actualized that the test pattern T is produced with two kinds of ink having a high possibility of being mixed together. Accordingly, the user can easily judge the setting value of the light energy without being disturbed by other colors.

In addition, it is a matter of course that this invention is not limited to the above-mentioned embodiment but can be suitably altered. For example, in this embodiment, a test pattern is produced by the utilization of two sets composed of a set of the light radiation device which is the object of the adjustment and the printing head corresponding to the light radiation device concerned, and a set of the light radiation device adjacent to the light radiation device which is the object of the adjustment at its downstream side and the printing head corresponding to the neighboring light radiation device; however, it is also appropriate to produce a test pattern by the utilization of the three or more sets. In such cases, it is possible to adjust a plurality of light radiation devices by means of one test pattern.

According to the structure (2), it is possible to radiate light to ink drops jetted from any one of the printing heads immediately after landing, and the ink drops after landing are to be hardened before ink drops are jetted from the next printing head. Accordingly, it is possible to prevent ink dots of different colors from being mixed with one another.

Further, if the interval between the printing head and the light radiation device corresponding to the printing head making a set is made uniform over all the sets, the time intervals between the landing and the radiation by the light from the light radiation devices can be made uniform, which makes it possible to prevent dot diameters from having a dispersion.

Further, because a test pattern for a user judging whether or not the light energy of each of the light radiation devices is proper is produced on a recording medium by the control of the control device, the user can judge the setting value of the light energy most suitable to the image recording on the basis of the result of production of the test pattern. Further, if the setting value judged by the user is inputted to the operation section, the control device controls the plural light radiation devices on the basis of the input result and records an image. By this, it is possible to obtain a high quality image which is excellent also from the viewpoint of energy saving.

According to the structure (3), it is actualized that the test pattern is produced at least with two kinds of ink having a high possibility of being mixed together included. Accordingly, a user, making it the basis of the judgement the portions of the test pattern composed of two kinds of ink having a high possibility of being mixed together, can judge the setting value of the light energy enabling the suppression of the color mixing to the utmost. Especially, by producing a test pattern by means of the above-mentioned two sets of the light radiation device and the printing head, the user can judge the setting value of the light energy easily without being disturbed by other colors.

In the following, a further another embodiment of this invention will be explained with reference to FIG. 10 to FIG. 17(*b*).

Figure 10:
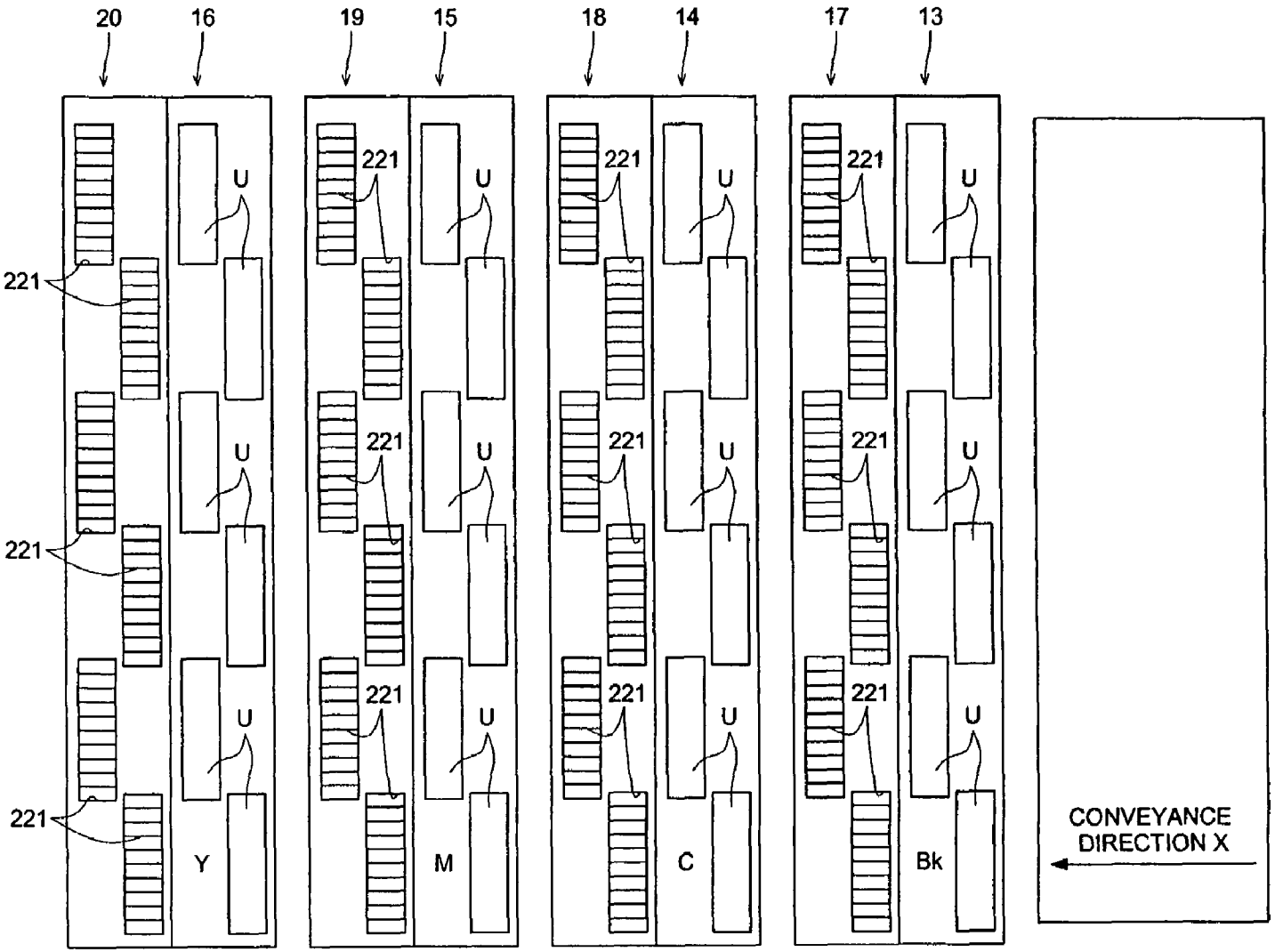
FIG. 10 is a bottom view representing the printing heads and the light radiation devices provided in the image recording apparatus shown in FIG. 1.
Figure 11:
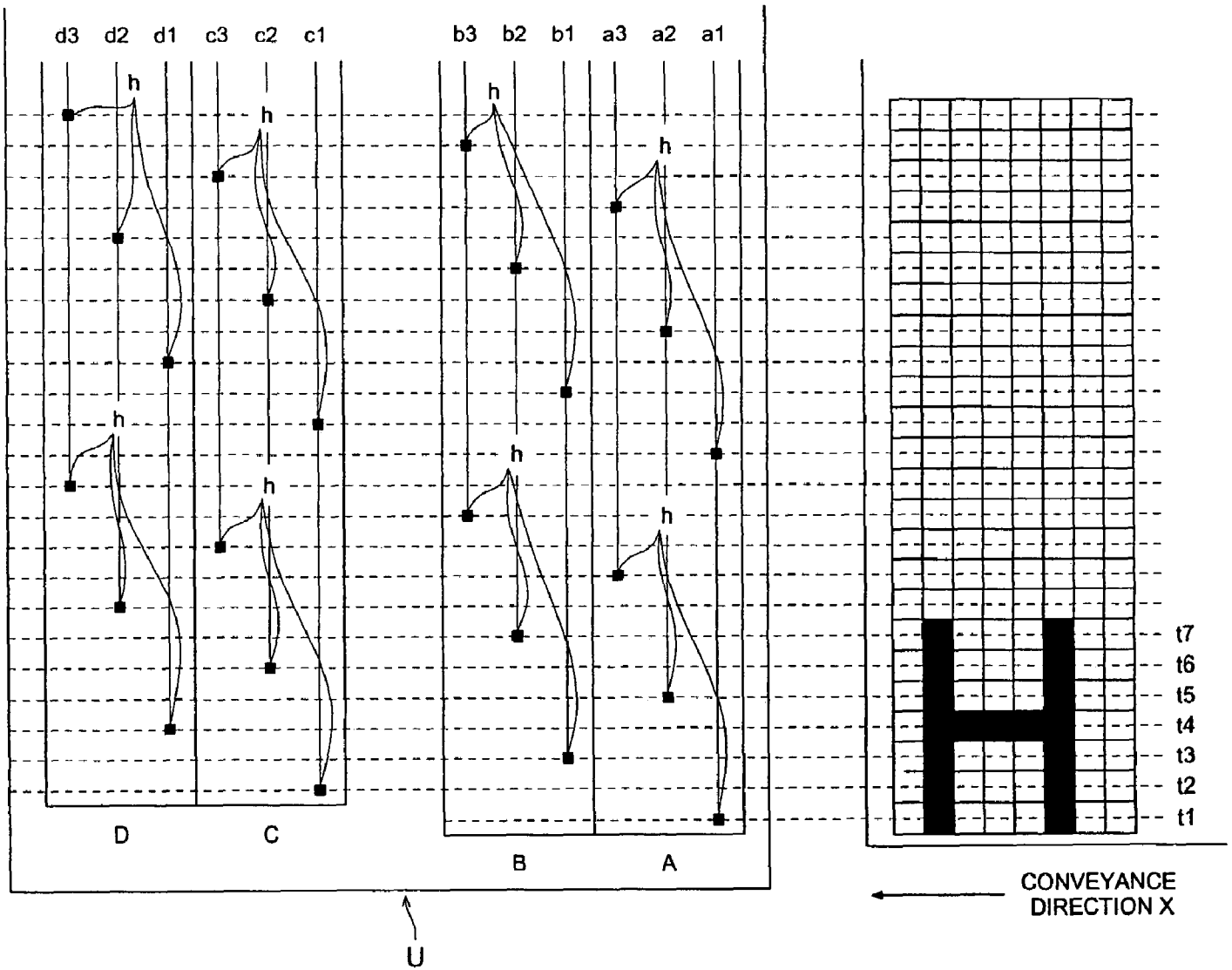
FIG. 11 is a bottom view representing the nozzles of the unit head provided in the printing head shown in FIG. 10.
Figure 12:
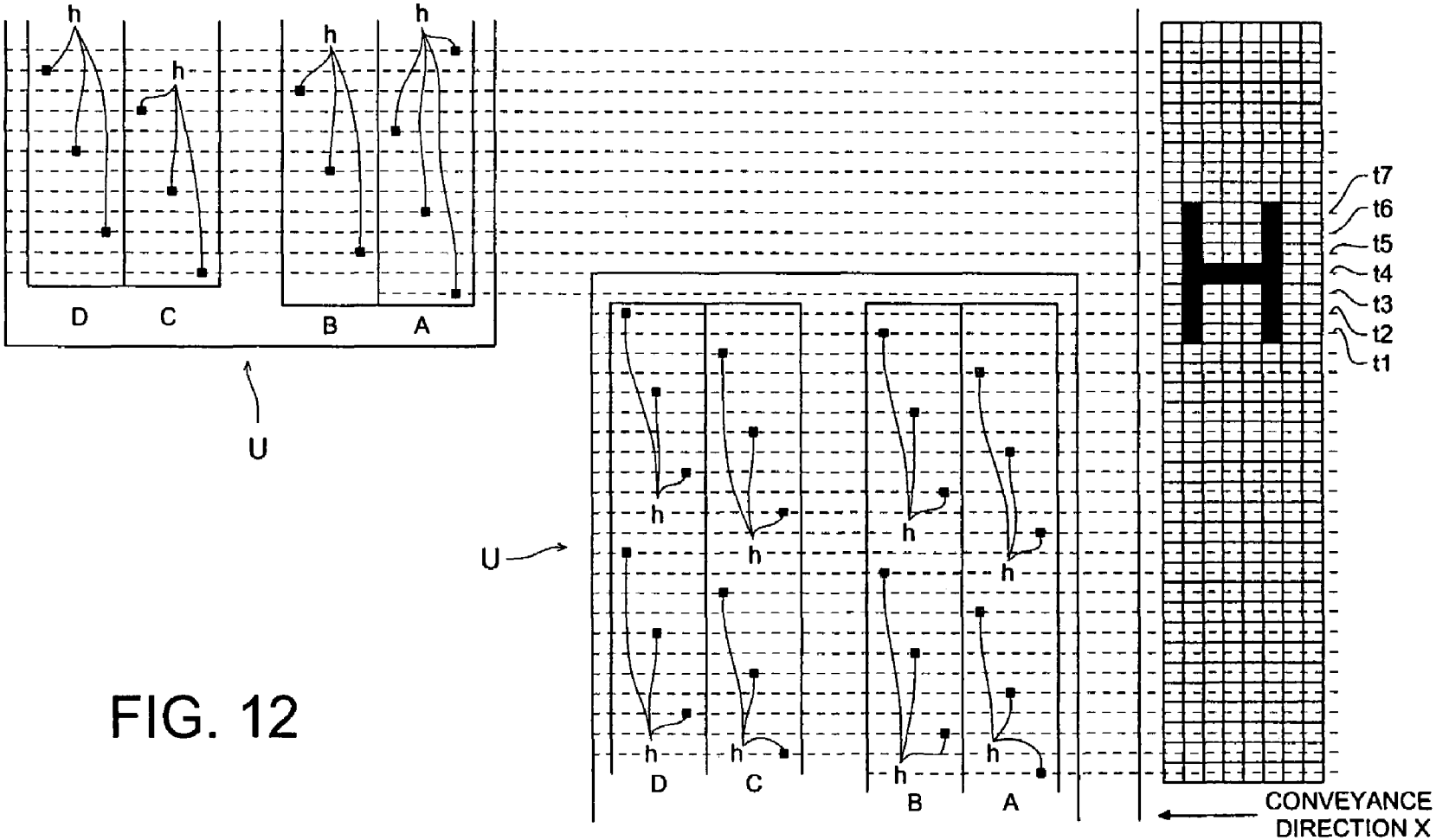
FIG. 12 is a bottom view representing the nozzles of the plural unit heads provided in the printing head shown in FIG. 10.

FIG. 10 is a bottom view representing the outline structure of printing heads 13, 14, 15, and 16, and in each of the printing heads 13, 14, 15, and 16, a plurality of unit heads U for jetting ink drops are arranged in a zigzag way along the direction perpendicular to the conveyance direction X. FIG. 11 and FIG. 12 are illustration drawings showing the arrangement of nozzles h provided in the unit head U. As shown in FIG. 11 and FIG. 12, on the jetting surface of the unit head U facing a recording medium sheet 2, four rows A to D of nozzles h are arranged. In each of the rows A to D, nozzles h are arranged in such a way that they are composed of nozzle groups comprising three nozzles, each group being arranged at specified intervals in the direction perpendicular to the conveyance direction X, and in each group, the three nozzles are deviated in the conveyance direction X with a specified pitch and also in the direction perpendicular to X with the above-mentioned interval. Further, the start points of the rows A to D are deviated by one pixel in the direction perpendicular to the conveyance direction X in the order of A, C, B, D. By this arrangement, it is actualized that in response to the conveyance of a recording medium sheet 2, the nozzle rows A to D of a unit head U jet ink drops in the order of row a1, row a2, row a3 in A, row b1, row b2, row b3 in B, row c1, row c2, row c3 in C, and row d1, row d2, row d3 in D.

By the jetting of ink drops from the nozzles h arranged in the above-mentioned way, it is possible to record an image on a recording medium sheet 2. For example, as shown in FIG. 11, in a case where a letter "H" is to be recorded, as regards the lines forming the letter "H", ink drops are jetted from the nozzles, which are the first one in row A for the line t1, the first one in row C for the line t2, the first one in row B for the line t3, the first one in row D for the line t4, the second one in row A for the line t5, the second one in row C for the line t6, and the second one in row B for the line t7. Further, as shown in FIG. 12, in a case where a letter (for example, "H") is recorded by a plurality of unit heads U, as regards the lines forming the letter "H", ink drops are jetted from the nozzles, which are the first one from the top in row B of the lower-side unit head U as shown in FIG. 12 for the line t1, the first one from the top in row C of the lower-side unit head U for the line t2, the first one from the bottom in row A of the upper-side unit head U as shown in FIG. 12 for the line t3, the first one from the bottom in row C of the upper-side unit head U for the line t4, the first one from the bottom in row B of the upper-side unit head U for the line t5, the first one from the bottom in row D of the upper-side unit head U for the line t6, and the second one from the bottom in row A of the upper-side unit head U.

Further, as shown in FIG. 1, in the upper neighborhood of the conveyance belt 41 and at the downstream side of each of the printing heads 13, 14, 15, and 16 with respect to the conveyance direction X, there is provided each of light radiation devices 17, 18, 19, and 20 for radiating light of a specified wavelength to ink drops jetted from the printing heads 13, 14, 15, and 16 to a recording medium sheet 2 to harden the surface of the ink drops, corresponding to each of the printing heads 13, 14, 15, and 16 respectively.

Figure 13:
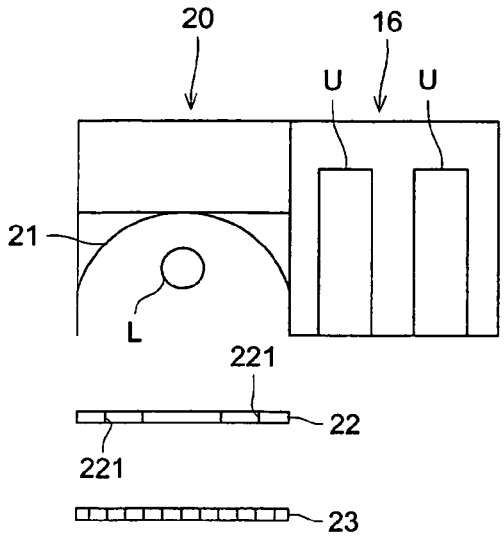
FIG. 13 is an exploded drawing representing a side cross-section of the light radiation device provided in the image recording apparatus shown in FIG. 1.

Because the structure of the light radiation devices 17, 18, 19, and 20 are all the same one another, only the light radiation device 20 will be explained and the explanation of the light radiation devices 17, 18, and 19 will be omitted. FIG. 13 is an exploded view showing a side cross-section of the light radiation device 20.

In the light radiation device 20, as shown in FIG. 13, there is provided a light source L for emitting light extending over the whole width of the corresponding printing head 16. For the light source L, there is no particular limitation, but it is desirable to use, for example, a fluorescent light tube to generate ultraviolet rays.

At the side toward a recording medium sheet 2 with respect to the light source L in the light radiation device 20, there is disposed a slit member 22 having a plurality of slits 221 for transmitting the light from the light source L to the recording medium sheet 2. As shown in FIG. 10, the plural slits 221 correspond to the plural unit heads U provided in the printing head 16 respectively, and are arranged in a zigzag way along the direction perpendicular to the conveyance direction X in such a way as to make the interval between the slit 221 and the unit head U of a couple uniform over all the couples of them.

Further, at the side toward a recording medium sheet 2 with respect to the slit member 22, a light transmitting protection member 23 for preventing the adherence of ink mist, dusts, etc. to the light source L is provided in such a manner as to cover all the slits and to be capable of replacement. The protection member 23 may be any kind of member so long as it has a light transmittance and covers the slits 221, and for example, a filter or the like formed of resin or glass having a light transmittance can be cited.

Further, at the side opposite to the recording medium sheet 2 with respect to the light source in the light radiation device 20, there is provided a reflection member 21 having approximately a parabolical shape for converging the light from the light source L onto each of the plural slits 221. The curvature of this reflection member 21 is determined to be such one as to make the light from the light source a parallel light beam by reflection.

Figure 14:
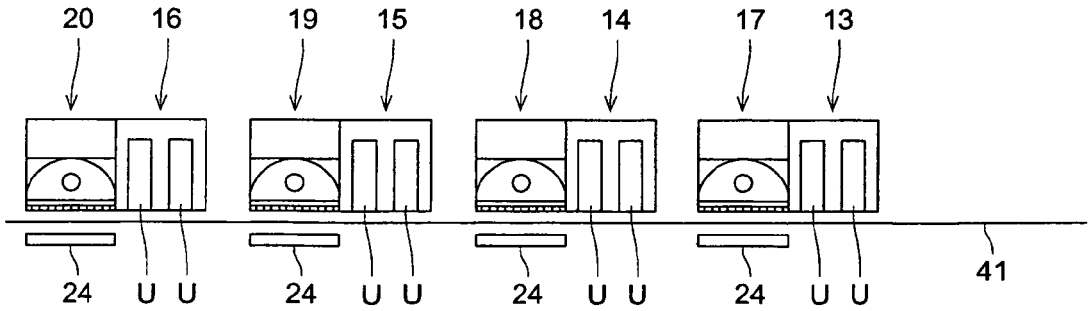
FIG. 14 is a side view representing the printing heads and the light radiation devices shown in FIG. 10.

Under the light radiation devices 17, 18, 19, and 20, as shown in FIG. 14, there are provided a plurality of light amount measuring sensors 24 for measuring the quantity of light having passed the slits 221 and the protection member 23 facing the slit members 22 respectively. These light amount measuring sensors 24 should be disposed at positions not to hinder the conveyance of a recording medium sheet 2 at the time of image recording, and should be disposed facing their respective slit members 22 at the time of measuring the quantity of light from the light radiation devices 17, 18, 19, and 20. In this embodiment, the light amount measuring sensors are disposed in such a way as to face their respective slit members with the conveyance belt positioned in between; therefore, the sensors are brought into a state not to hinder the conveyance of a recording medium sheet 2 at the time of image recording. For this purpose, the light amount measuring sensors are made to face their respective slit members 22, and in order to make the light from the light radiation devices 17, 18, 19, and 20 reach the light amount measuring sensors 24 with certainty, the conveyance belt 41 is split into a plurality of parts along the direction perpendicular to the conveyance direction X.

In addition, in addition to the above-mentioned structure, it is also appropriate to make the structure such that the light amount sensors 24 disposed at positions not to hinder the conveyance of a recording medium sheet 2 at the time of image recording are moved to come to face their respective slit members 22.

Besides, the inks to be used in this embodiment are inks that are hardened by the radiation of light, in particular, inks of an ultraviolet-setting type that are hardened by the radiation of ultraviolet rays. Inks of an ultraviolet-setting type are generally classified into inks of a radical polymerization type containing a compound capable of radical polymerization as a polymerizable compound and inks of a cation polymerization type containing a compound capable of cation polymerization; both of these two types of ink can be employed for the ink to be used in this embodiment, and also it is appropriate to employ an ink of a hybrid type composed of an ink of a radical polymerization type and an ink of a cation polymerization type combined for the ink to be used in this embodiment.

Figure 15:
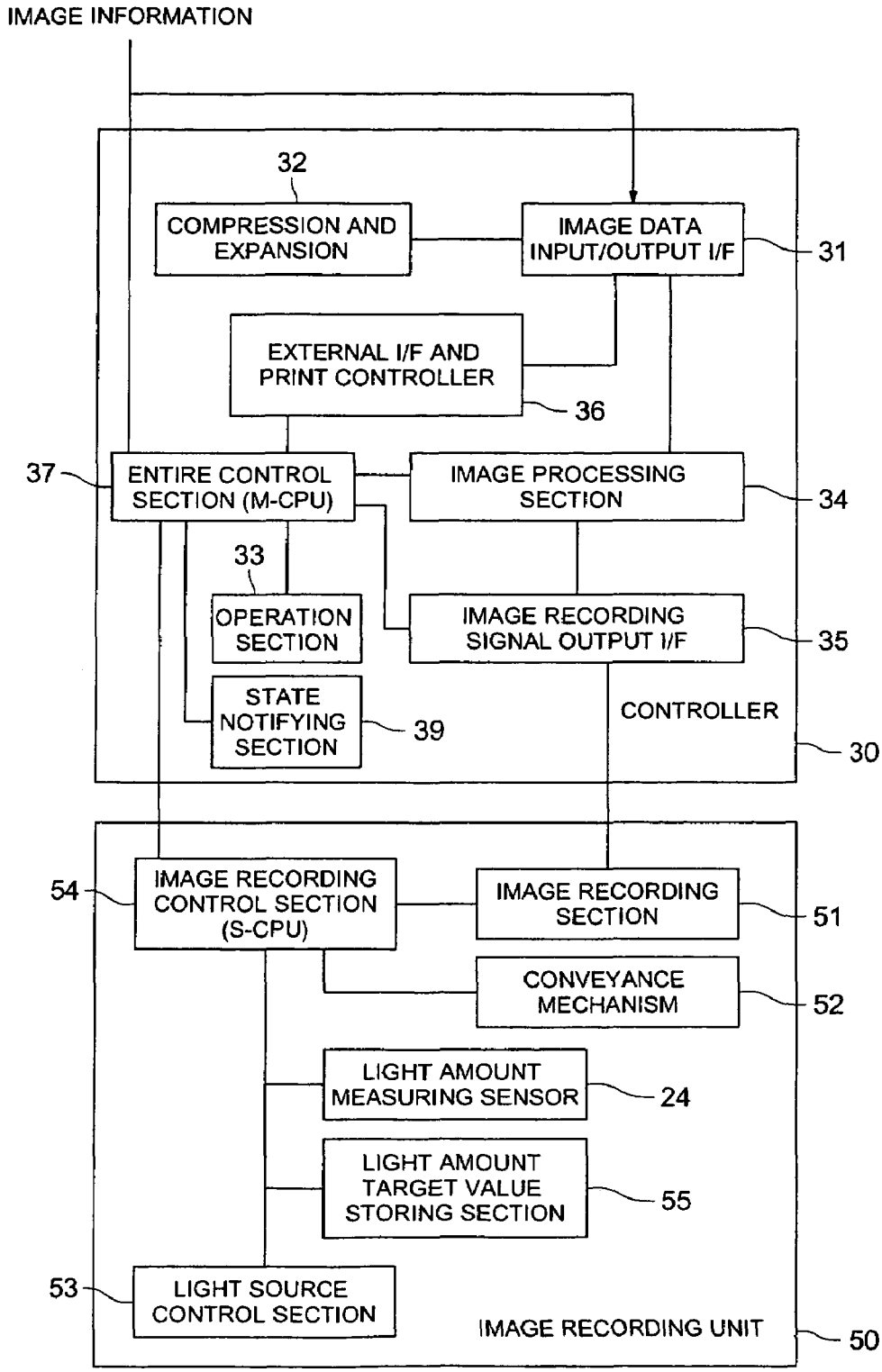
FIG. 15 is a block diagram representing another example of the main control part of the image recording apparatus shown in FIG. 1.

FIG. 15 is a drawing showing a control device for controlling an image recording apparatus 1 in this embodiment of the invention; this control device is composed of, for example, a CPU, a ROM, and a RAM (all are not shown in the drawing), and comprises a controller 30 for developing any one of the processing programs stored in the ROM and practicing this processing program by the CPU.

In the controller 30, there are provided an image data input and output I/F (interface) 31 for receiving image information transmitted to the image recording apparatus, and a compression/expansion section 32 for compressing transferred image data by page unit to store them therein, and further expanding the compressed image data to store them therein. For the compression/expansion means in this case, JPEG, JPEG2000, JBIG, etc. known to the public can be used. Further, in the controller 30, there are provided an operation section 33 for a user to carry out the inputting of the number of sheets of output, the number of copies, etc. by operation, a notification section 39 for notifying a user of the state of the image recording apparatus 1 (for example, warning means for giving warning to an operator when a light amount incident to a sensor is insufficient), an image processing section 34 for transforming image data obtained into data adapted to the image output format, and an image recording signal output I/F 35 for outputting the image data transformed in the image processing section 34 to an image recording section 51 of an image recording unit 50. Further, in the controller 30, there are provided an external I/F and print controller 36 for taking in image data obtained through a pickup process by means of an image pickup apparatus such as a digital camera or image data read by another reading apparatus and carrying out image recording based on an instruction from an external apparatus. Further, in the controller 30, there is provided an entire control section (M-CPU) 37 for controlling the operation of the image processing section 34, the image recording signal output I/F 35, and the external I/F and print controller 36 in accordance with the operation section 33 and the above-mentioned image information.

In the image recording unit 50, there are provided the image recording section 51 for carrying out image recording in accordance with a signal from the image recording signal output I/F 35, a conveyance mechanism 52 for making the conveyance rollers 11 and the tension rollers 42 operate, a light source control section 53 for controlling the output of the light radiation devices 17, 18, 19, and 20 in accordance with a control signal from the image recording section 51, a target light amount value storing section 55 for storing a target value of each of the light radiation devices 17, 18, 19, and 20, and an image recording control section (S-CPU) 54 for controlling the operation of the above-mentioned structural components. Further, to the image recording control section 54, the light amount measuring sensors 24 are connected.

Figure 16:
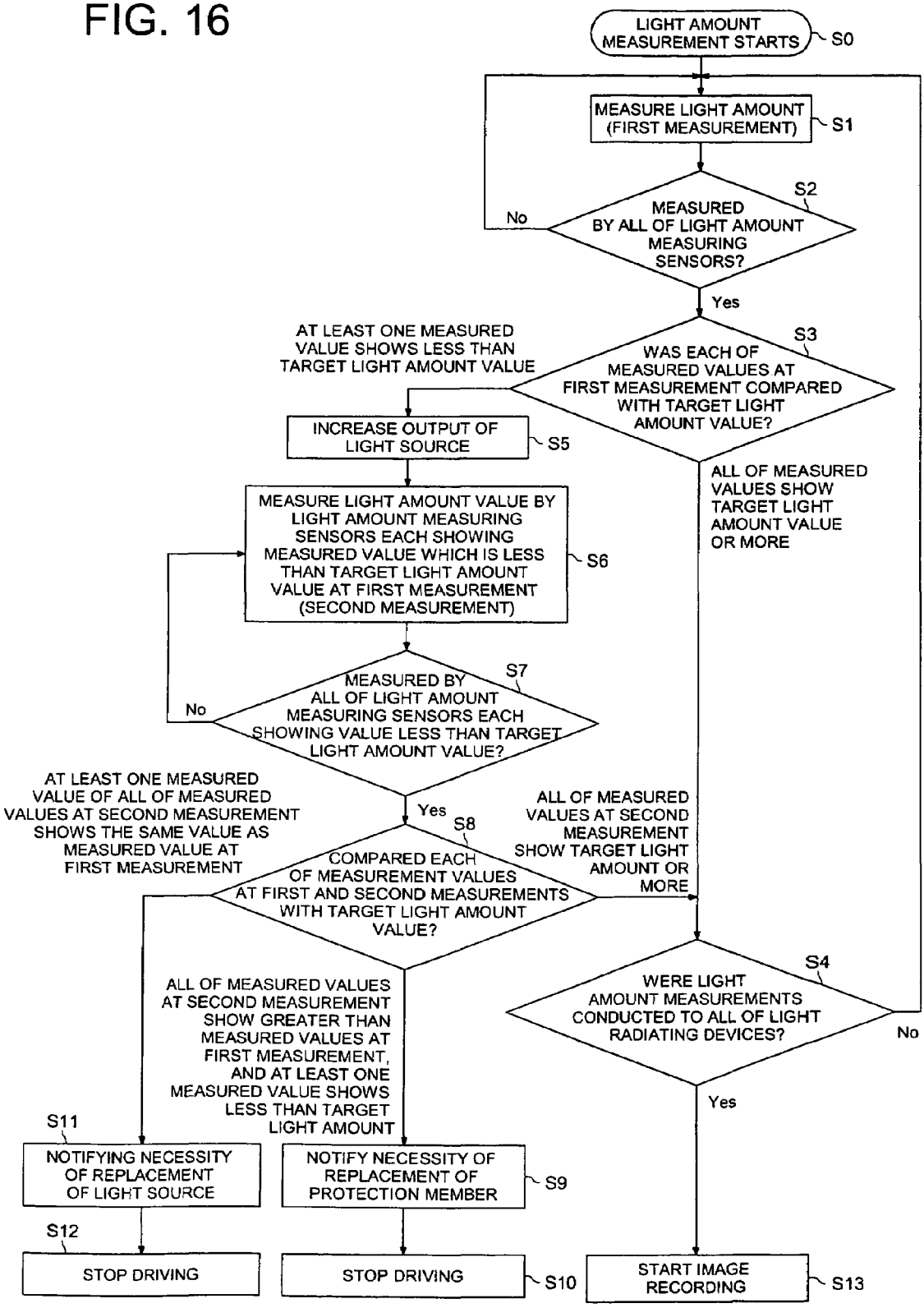
FIG. 16 is a flow chart showing a control procedure to be practiced at the time of light amount measurement by the control section shown in FIG. 1.

Next, the operation of the image recording apparatus of this embodiment will be explained with reference to FIG. 16. FIG. 16 is a flow chart at the time of measuring the quantity of light.

First, when an instruction of image recording is inputted from the operation section 33, the entire control section 37 outputs an instruction of light amount measurement of the light radiation apparatus 17, 18, 19, and 20 to the image recording control section 54. The image recording control section 54, having the instruction of light amount measurement inputted thereto, controls the conveyance mechanism 52 so as to make the opening portions of the conveyance belt 41 positioned under their respective slits 221, and also controls the light source control section 53 to turn on the light source of the light radiation devices 17, 18, 19, and 20, to start light amount measurement (step S0). At this time, the light source control section 53 turns on the light source L of the light radiation devices 17, 18, 19, and 20 at an initially set output value. In the above description, the initially set output value is a value to make it possible for the light from the light source L transmitted through the slits 221 and the protection member 23 to harden ink drops on a recording medium sheet 2, in the case where the light source L functions normally.

Accompanied by the start of light amount measurement, first, the light amount values of the light beams transmitted through their respective slits 221 provided in the light radiation device 17 are measured by the plural light amount measuring sensors provided for the light radiation device 17 (first measurement) (step S1, S2).

After that, the image recording control section 54 reads out the target light amount value of the light radiation device 17 from the light amount target value storing section 55, to compare it with all the measured values (step S3). As the result of the comparison, if all the measured values are not less than the target light amount value, the procedure moves to the step S4, and if at least one measured value is less than the target light amount value, the procedure moves to the step S5.

When the procedure moves to the step S5, the image recording control section 54 controls the light source control section 53 so as to turn on the light source L at an output value increased from the initially set output value. After that, by the light amount measuring sensors 24 which have measured a value less than the target light amount value in the first measurement, the light amount of the light beams passing the slits 221 are measured again (second measurement) (step S6, S7).

Then, the image recording control section 54 compares the measured values by the first measurement, the measured values by the second measurement, and the target light amount value with one another (step S8). As the result of this comparison, although all the measured values in the second measurement are greater than their respective measured values in the first measurement, if at least one of them is less than the target light amount value, the procedure moves to the step S9, and the image recording control section 54 outputs the result to the entire control section 37. The entire control section 37 controls the notification section 39 so as to notify the user of the necessity of replacement of the protection member 23, and after that, it stops the actuation of the image recording apparatus 1 (step S10).

Further, as the result of the comparison, if at least one of the measured values in the second measurement is the same as the measured value concerned in the first embodiment, the procedure moves to the step S11 and the image recording control section 54 outputs the result to the entire control section 37. The entire control section 37 controls the notification section 39 to notify the operator of the necessity of replacement of the light source L, and after that, it stops the actuation of the image recording apparatus 1 (step S12).

Further, as the result of the comparison, if the measured values in the second measurement are not less than the target light amount value, the procedure moves to the step S4. In the step S4, because the light amount of the light radiation device 17 is not less than the target light amount value, the light amount measurement of the next light radiation device 18 is started. The above-mentioned processes are repeated for all the light radiation devices 17, 18, 19, and 20, and if the light amount of all the light radiation devices 17, 18, 19, and 20 are not less than the target light amount value, the image recording control section 55 outputs a start of image recording signal to the entire control section 37 (step S13).

When image information is transmitted to the image recording apparatus 1, as shown in FIG. 15, the transmission of image information is done to the entire control section 37 of the controller 30, and also to the image processing section 34 from the image data input and output I/F 31. Besides, image information is also transmitted to the entire control section 37 from an external apparatus or the like through the external I/F and print controller 36.

The entire control section 37 makes the operation of the structural components of the controller 30 start when image information has been transmitted to it. In addition, as regards the timing of this start of the operation, it is not limited to the time of input of image information, but also it is appropriate to start the operation when an operational input by a user is made from the operation section 33 or when an operational input from an external apparatus is made through the external I/F and print controller 36.

In the image processing section 34, image processing is applied to image data so as to make the image information adapted to the image output format, that is, so as to make image information optimum for an image recording apparatus using photo-setting inks to record an image. The image data composed of color signals that have been subjected to the image processing are transmitted from the image recording signal output I/F 35 to the image recording section 51 of the image recording unit 50.

In addition, also it is possible to transmit image information prior to image processing from the image data input and output I/F 31 to the compression/expansion section 32 to store the information therein. Besides, the compression/expansion section 32 operates not only at the time image data have been transmitted from the image processing section 34 but also at the time an operational input for the start of operation or the like has been made from an external apparatus through the external I/F and print controller 36.

On the other hand, when image information is transmitted to the image recording apparatus 1, the image recording control section 54 of the image recording unit 50 brings the conveyance mechanism 52 and the light source control section 53 into operation on the basis of the color signals stored in the color signal storage 57 of the image recording section 51. Accompanied by this operation, the printing head driving circuit 58 brings the printing heads 13, 14, 15, and 16 into operation. To state it concretely, the conveyance mechanism 52 brings the takeout device 5 into operation, to take out the uppermost recording medium sheet 2 accommodated in the accommodation tray 3, and brings the conveyance rollers 11 into rotational operation to make them convey this recording medium sheet 2 having been taken out.

Further, when the leading edge of the recording medium sheet 2 has reached the conveyance belt 41, the pressing roller 43 presses the leading edge portion of the recording medium sheet 2 to the circumferential surface of the conveyance belt 41 to make it hold the sheet. Because the conveyance belt 41 is made to revolve by the tension rollers 42, the recording medium sheet 2 is conveyed with the revolution. When the recording medium sheet 2 is conveyed to the position of the printing head 13, black ink drops are jetted from the printing head 13, and immediately after that, the black ink drops are hardened by the radiation of light from the light radiation device 17. Subsequently, cyan ink drops are jetted to the recording medium sheet 2 from the printing head 14, and the cyan ink drops are hardened by the radiation of light from the light radiation device 18. In the same way, the printing head 15 is brought into operation to jet magenta ink drops onto the recording medium sheet 2, and the ink drops are hardened by the light radiation device 19. After that, the printing head 16 is brought into operation to jet yellow ink drops onto the recording medium sheet 2, and all the ink drops which have been landed on the recording medium sheet 2 are completely hardened by the light radiation device 20.

After complete hardening, when the leading edge portion of the recording medium sheet 2 is detached from the circumferential surface of the conveyance belt 41, the recording medium sheet 2 is conveyed by the conveyance rollers 11, to be ejected onto an output tray 9.

As explained up to now, by the image recording apparatus 1 of this embodiment, the control device compares the measured values of each of the plural light radiation devices 17, 18, 19, and 20 with the target light radiation value before recording an image, and if at least one measured value among the respective measured values of the plural light radiation devices 17, 18, 19, and 20 is less than the target light amount value, the light amount value of the light radiation device 17, 18, 19, or 20 which is less than the target light amount value is increased until it reaches or exceeds the target light amount value; therefore, even though the light radiation device is smudged owing to the adherence of ink mist etc., a light amount necessary for the hardening of the ink drops can be secured, and an image of stabilized quality can be recorded.

Further, because the distance between the unit head and the slit 221 corresponding thereto in a couple is kept uniform over all the couples of them, for ink drops from whichever unit head they may be jetted, the time interval between the landing and the radiation by light can be kept constant. Accordingly, the dispersion of dot diameters can be suppressed, which improves image quality.

Further, in the light radiation devices 17, 18, 19, and 20, there are provided their respective protection members 23 for protecting the light sources L against smudging; therefore, the light sources L themselves are never smudged, and even though the light amount of any light source L is lowered, by the replacement of the protection member 23 concerned, the light amount can be recovered.

Further, also in the light radiation device 17, 18, 19, or 20 for which it has been attempted to increase the quantity of light, if the detection result by the light amount measuring sensor corresponding to the light radiation device 17, 18, 19, or 20 concerned indicates the increase of the quantity of light, although it does not reach the target light amount value, the notification section 39 notifies a user of the replacement of the protection member 23 of the light radiation device 17, 18, 19, or 20 concerned; therefore, it never occurs for the user to make an error in the timing of replacement of the protection member 23, and the protection member 23 can be replaced with certainty.

Moreover, also in the light radiation device 17, 18, 19, or 20 for which it has been attempted to increase the quantity of light, if the detection result by the light amount measuring sensor corresponding to the light radiation device 17, 18, 19, or 20 concerned indicates no increase of the quantity of light, the notification section 39 notifies a user of the replacement of the light source L of the light radiation device 17, 18, 19, or 20 concerned; therefore, it never occurs for a user to make an error in the timing of replacement of the light source L, and the light source L can be replaced with certainty.

In addition, this invention is not limited to the above-mentioned embodiment, but it is a matter of course that it can be suitably altered. For example, in each of the light radiation devices 17, 18, 19, and 20 as shown in the example of this embodiment, slits 221 for transmitting the light from a single light source L provided in such a way as to come to correspond to the unit heads respectively are used; however, also it is appropriate to use a light radiation device having a plurality of light sources arranged in such a way that they come to correspond to their respective unit heads U. In such a case, because the light amount can be controlled for each light source, it is possible to carry out a more precise control.

Figure 17:
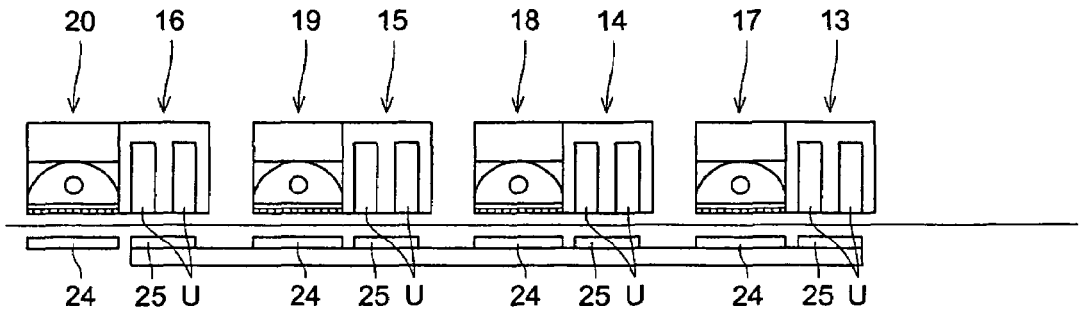
FIG. 17(*a*) and FIG. 17(*b*) are illustration drawings each representing an example of modification of an image recording apparatus.
Figure 17:
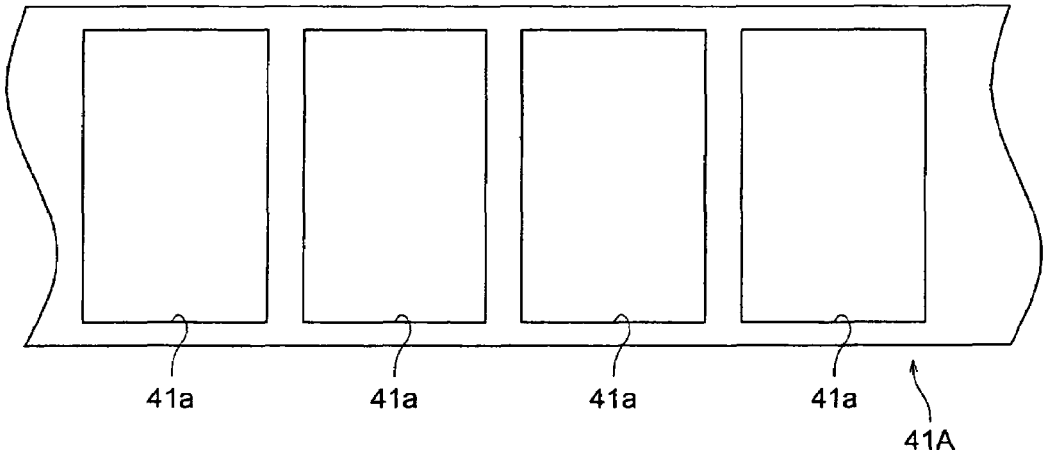

Further, in this embodiment, the conveyance belt 41 is split into a plurality of portions along the direction perpendicular to the conveyance direction X so as to make the light from the light radiation devices 17, 18, 19, and 20 reach the light amount measuring sensors 24 with certainty; however, for example, as shown in FIG. 17(*b*), also it is appropriate to form opening portions 41*a* for making the light amount measuring sensors 24 face the light radiation devices 17, 18, 19, and 20 in the conveyance belt 41A, corresponding to their respective light amount measuring sensors 24. In such a case, in order to make it possible for the conveyance belt 41A to convey a recording medium sheet 2 with its flatness maintained, the conveyance belt 41A has a structure such that each of the opening portions 41*a* are formed of a flexible metallic member, and at both the edges, the belt material is fixed. Further, if these opening portions 41*a* are opened to have a size enough to make the printing heads 13, 14, 15, and 16 face downward their respective light amount measuring sensors 24 corresponding thereto, for example, as shown in FIG. 17(*a*), cap members 25 capable of moving up and down for covering their respective printing heads 13, 14, 15, and 16 in a maintenance operation can be disposed under the conveyance belt 41A; owing to this, even at the time of a maintenance operation for the printing heads 13, 14, 15, and 16 and of a measurement operation for the light amount of the light radiation devices 17, 18, 19, and 20, the conveyance belt 41A does not hinder the operation.

According to the structure (4), the light radiation devices themselves can be prevented from being smudged, and even if the light amount is lowered, it can be recovered by the replacement of the protection member.

Further, the control device compares the measured value of each of the light radiation devices with the target light amount value prior to recording an image, and if any one of the measured values is less than the target light amount value, it increases the light amount of the light radiation device concerned until the light amount reaches or exceeds the target light amount value; therefore, even if the light radiation device is smudged by the adherence of ink mist etc., the light amount necessary for the hardening of ink drops can be secured and an image of a stabilized image quality can be recorded.

Further, if the measured value of the light radiation device does not reach the target light amount value notwithstanding the increasing of light amount having been attempted, the notification section notifies a user of the replacement of the protection member of the light radiation device concerned; therefore, it never happens for the user to make an error in the replacement timing of the protection member, and it is possible to make the replacement with certainty.

According to the structure (5), even in the case where a plurality of unit heads provided in a printing head are not arranged linearly, if the slits are formed in such a way as to have the distances from their respective unit heads made equal to one another, the time from the landing to the radiation can be made constant for ink drops from whichever unit head they may be jetted. Accordingly, the dispersion of dot diameters can be suppressed, and the image quality can be improved.

Further, because the protection member is disposed in such a way as to cover the slits, it is possible to prevent that ink mist etc. invade from the silts.

According to the structure (6), the replacement time of the light source is never mistaken, and the light source can be replaced with certainty.

What is claimed is:

1. An image recording apparatus, comprising:

a conveyance device for conveying a recording medium;

a printing head including a plurality of unit heads provided in a direction perpendicular to a conveyance direction of the recording medium for jetting ink drops having a photo-setting property toward the recording medium;

a plurality of light radiation devices, each of the light radiation devices having a light source arranged downstream from a position corresponding to each of the plurality of unit heads for radiating light emitted from the light source onto the ink drops on the recording medium;

a plurality of light transmitting protection members replaceably arranged between each of the plurality of light radiation devices and the recording medium;

a plurality of light amount measurement sensors arranged farther than the recording medium with respect to the light transmitting protection members;

a storage section for storing a target light amount value for each of the plurality of light radiation devices;

a notification section for notifying an operator of a state of each of the plurality of light radiation devices; and a controller for controlling a light amount of each of the plurality of light radiation devices and the notification section on the basis of values measured by the light amount measurement sensors and the target light amount value output from the storage section, wherein the controller compares each of the measured values from each of the light radiation devices with the target light amount value prior to an image recording operation, and when each of the measured values is less than the target light amount value, the controller increases a light amount of the corresponding light radiation device until the light amount is greater than or equal to the target light amount, and wherein after the light amount of the corresponding light radiation device increases, the controller controls the notification section to notify the operator to replace the protection member if the measured value of the corresponding light radiation device does not reach the target light amount.

2. The image recording apparatus of claim 1, wherein each of the light radiation devices further comprises:

a slit member having a plurality of slits for transmitting light emitted from the light source onto the recording medium, the slit member provided between the light source and the recording medium and positioned to correspond to each of the plurality of unit heads, respectively;

a reflector provided on an opposite side of the light source with respect to the recording medium for converging the light emitted from the light source onto each of the plurality of slits, wherein the light source is arranged to extend over an entire width of the printing head in the direction perpendicular to the conveyance direction of the recording medium, and wherein the protection member is arranged to cover the slit member.

3. The image recording apparatus of claim 1, wherein after the light amount of the corresponding light radiation device increases, the controller controls the notification section to notify the operator to replace the light source if the measured value of the corresponding light radiation device does not exceed the measured value that was obtained before the light amount was increased.

* * * * *